US012280318B1

(12) United States Patent
Sun

(10) Patent No.: US 12,280,318 B1
(45) Date of Patent: Apr. 22, 2025

(54) WATER TOY

(71) Applicant: Furui Zhong, Guangdong (CN)

(72) Inventor: Jianghai Sun, Guangdong (CN)

(73) Assignee: Furui Zhong, Shanwei (CN)

( * ) Notice: Subject to any disclaimer, the term of this patent is extended or adjusted under 35 U.S.C. 154(b) by 0 days.

(21) Appl. No.: 18/822,379

(22) Filed: Sep. 2, 2024

Related U.S. Application Data

(63) Continuation-in-part of application No. 18/539,553, filed on Dec. 14, 2023, now Pat. No. 12,109,506.

(51) Int. Cl.
*A63H 23/10* (2006.01)
*A63H 23/00* (2006.01)
*A63H 33/26* (2006.01)

(52) U.S. Cl.
CPC ..... *A63H 23/10* (2013.01); *A63H 23/005* (2013.01)

(58) Field of Classification Search
CPC ..... A63H 23/00; A63H 23/005; A63H 23/10; A63H 29/22; A63H 33/28
USPC ..... 446/153, 484; 222/333
See application file for complete search history.

(56) References Cited

U.S. PATENT DOCUMENTS 4,235,378 A * 11/1980 Melin ..... A63H 23/10 446/153
4,239,129 A * 12/1980 Esposito ..... F41B 9/0018 362/112
4,540,376 A * 9/1985 Turbowitz ..... A63H 23/04 446/443
4,706,848 A * 11/1987 D'Andrade ..... F41B 9/0037 222/340
4,750,641 A * 6/1988 Chin-Fu ..... F41B 9/0037 446/475
5,263,714 A * 11/1993 Rudell ..... A63F 9/00 446/176
5,348,508 A * 9/1994 Garfinkel ..... A63H 17/34 40/407
5,586,688 A * 12/1996 Johnson ..... F41B 9/0021 200/82 R
6,474,507 B1 * 11/2002 Hornsby ..... F41B 9/0028 222/113
6,602,089 B2 * 8/2003 Abe ..... H01R 12/675 439/417

(Continued)

FOREIGN PATENT DOCUMENTS

CN 201684418 U * 12/2010
CN 203736849 U * 7/2014

(Continued)

*Primary Examiner* — Alexander R Niconovich

(57) ABSTRACT

A water toy includes a water toy main body. The water toy main body includes a first waterproof integrated box. The first waterproof integrated box is configured to accommodate an electronic element. The first waterproof integrated box includes a first upper shell, a first lower shell, a sealing member, and a waterproof chamber. The first upper shell and the first lower shell are covered with each other. The sealing member is arranged at mounting ports of the first upper shell and the first lower shell. After the first upper shell and the first lower shell are covered with each other, the sealing member seals a gap between the first upper shell and the first lower shell to form the waterproof chamber. The first upper shell and the first lower shell are detachably connected through a clasp.

20 Claims, 27 Drawing Sheets

(56) References Cited

U.S. PATENT DOCUMENTS 6,793,552 B2 * 9/2004 Derrah ..... A63H 13/045 446/457
6,814,634 B2 * 11/2004 Roberts ..... B63H 11/08 440/38
6,905,388 B2 * 6/2005 Schoonmaker ..... A63H 23/10 446/156
7,497,758 B2 * 3/2009 Hamasaki ..... A63H 23/04 446/160
7,927,175 B2 * 4/2011 Coffey ..... F41B 9/0021 446/153
8,087,968 B2 * 1/2012 Amron ..... B05B 11/1001 446/15
8,315,040 B2 * 11/2012 Roberts ..... H01R 4/2429 361/728
8,794,486 B2 * 8/2014 Wolfinbarger ..... F41B 9/0071 446/153
8,872,025 B2 * 10/2014 Tamai ..... B62D 5/0406 361/728
9,884,260 B2 * 2/2018 Weisman ..... A63H 23/16
10,201,106 B2 * 2/2019 Sprowl ..... H05K 5/061
10,610,797 B2 * 4/2020 Weisman ..... A63H 23/14
2005/0035148 A1 * 2/2005 Zimmerman ..... F41B 9/0021 222/401
2005/0085158 A1 * 4/2005 Tsang ..... A63H 3/24 446/304
2005/0112990 A1 * 5/2005 Higashida ..... A63H 23/08 446/161
2005/0208867 A1 * 9/2005 Higashida ..... A63H 23/04 446/153
2009/0247043 A1 * 10/2009 Liao ..... B05B 15/00 446/405
2010/0015881 A1 * 1/2010 Bickmore ..... A47K 3/001 446/153
2011/0059675 A1 * 3/2011 Liebling ..... A63H 23/10 446/153
2011/0287688 A1 * 11/2011 Hang ..... A63H 23/10 446/153
2011/0306265 A1 * 12/2011 Mor ..... A63H 23/12 446/15
2014/0099855 A1 * 4/2014 Liberatore ..... F41B 9/0081 446/153
2015/0111461 A1 * 4/2015 Lu ..... A63H 23/08 446/153
2015/0190723 A1 * 7/2015 Liberatore ..... A63G 19/00 446/153
2015/0343322 A1 * 12/2015 Beavers ..... B01F 35/32025 446/15
2016/0050784 A1 * 2/2016 Ikeda ..... H05K 5/0056 220/3.8
2018/0001220 A1 * 1/2018 Desautels ..... A63H 23/10
2022/0134249 A1 * 5/2022 Atalla ..... A63H 23/04 446/154
2022/0168662 A1 * 6/2022 Kelly ..... A63J 5/028

FOREIGN PATENT DOCUMENTS

CN 212593987 U * 2/2021
CN 216653351 U * 6/2022
CN 217220174 U * 8/2022

* cited by examiner

WATER TOY

CROSS-REFERENCE TO RELATED APPLICATIONS

This application is a continuation in part of U.S. application Ser. No. 18/539,553, filed on Dec. 14, 2023, the content of which is incorporated by reference herein.

TECHNICAL FIELD

The present disclosure relates to a water toy applied in the field of toys.

BACKGROUND ART

Water toys generally refer to toys that can be played in water. There are two types of water toys on the market now. One is a water toy that achieves the function of spraying water through hand pressure. This hand pressure water toy is also quite boring to play with, resulting in low playability and fun, which can easily make players feel bored and lack fun. The other is a water toy with an electric water spray function, which is more interesting than the hand pressure water toy. However, some water toys with electric water spray function only have a spray switch design and have a relatively single function. If a multi-functional water toy with electric water spray function is needed, the design is more complex, and electronic elements need to be set up inside the water toy, such as circuit design, which require waterproof design. Therefore, electronic elements are generally designed in waterproof chambers. However, existing waterproof chambers are designed inside sealed shells that are non-removable or inconvenient to remove. Due to children's lack of protection awareness when playing with toys, the toys are prone to damage, the waterproof chambers are also prone to water ingress, or frequent use of the water spray switch can easily damage the circuit. The sealed shells that are non-removable or inconvenient to remove are not conducive to the maintenance of the water toys.

SUMMARY

In order to solve the problem mentioned above that the waterproof chambers designed for multifunctional water toys with electric water spray function in the prior art are all arranged inside sealed shells that cannot be disassembled or are inconvenient to disassemble, making it difficult to repair the water toys when electronic elements or circuits of the water toys are damaged, a water toy is provided in the present disclosure. The water toy is provided with a first waterproof integrated box; the first waterproof integrated box is configured to accommodate an electronic element; the first waterproof integrated box includes a first upper shell, a first lower shell, a sealing member, and a waterproof chamber; the first upper shell and the first lower shell are detachably connected to each other by a clasp; the detachable connection is convenient for opening the first waterproof integrated box and repairing the electronic element. The sealing member seals a gap between the first upper shell and the first lower shell after the first upper shell and the first lower shell are closed, to achieve a waterproof effect, so that the waterproof chamber is formed in the first waterproof integrated box to prevent water from entering the first waterproof integrated box and protect the electronic element.

The technical solution adopted by the present disclosure to solve the technical problem is as follows:

A water toy, wherein the water toy includes a water toy main body; the water toy main body includes a first waterproof integrated box; the first waterproof integrated box is configured to accommodate an electronic element; the first waterproof integrated box includes a first upper shell, a first lower shell, a sealing member, and a waterproof chamber; the first upper shell and the first lower shell are covered with each other; the sealing member is arranged at mounting ports of the first upper shell and the first lower shell; after the first upper shell and the first lower shell are covered with each other, the sealing member seals a gap between the first upper shell and the first lower shell to form the waterproof chamber; and the first upper shell and the first lower shell are detachably connected through a clasp.

Further, a groove is arranged on the first lower shell; the sealing member is arranged in the groove; the first upper shell is provided with a protrusion; the protrusion is inserted into the groove and compresses the sealing member, so that the first upper shell and the first lower shell are hermetically connected to each other; or a groove is arranged on the first upper shell; the sealing member is arranged in the groove; the first lower shell is provided with a protrusion; and the protrusion is inserted into the groove and compresses the sealing member, so that the first upper shell and the first lower shell are hermetically connected to each other.

Further, the water toy further includes a water outlet device and a second connecting component; the water outlet device is communicated to the water toy main body; the water outlet device is connected to the water toy main body through a second connecting component; the second connecting component includes a water pipe, a protective pipe, a first connecting fixing member, and a first fastener; a first end of the water pipe is connected to the water toy main body, and a second end of the water pipe is connected to the water outlet device; the first connecting fixing member sleeves the first end of the water pipe and is arranged inside the water toy main body; the protective pipe sleeves the water pipe and the first connecting fixing member; the first fastener sleeves the protective pipe; the first fastener compresses the protective pipe onto the first connecting fixing member; a first clamping slot is arranged on an outer side surface of the first connecting fixing member; and the first fastener compresses the protective pipe inside the first clamping slot.

Further, the second connecting component further includes a second connecting fixing member and a second fastener; the second connecting fixing member sleeves the second end of the water pipe and is arranged inside the water outlet device; the protective pipe also sleeves the second connecting fixing member; the second fastener sleeves the protective pipe, and the second fastener compresses the protective pipe onto the second connecting fixing member; a second clamping slot is arranged on an outer side surface of the second connecting fixing member; and the second fastener compresses the protective pipe inside the second clamping slot.

Further, the water toy further includes a water volume control switch and a water pumping component; the water toy main body further includes a first shell; the first waterproof integrated box and the water pumping component are arranged inside the first shell; the water volume control switch is arranged on the water outlet device; the water volume control switch is electrically connected to the water pumping component through a first wire; one end of the first wire is connected to the water pumping component; and the first wire passes between the water pipe and the protective pipe and is connected to the water volume control switch.

Further, the water outlet device includes a grip and a water outlet head; the grip is provided with more than one clamping block; the water outlet head is provided with a third clamping slot corresponding to the clamping block; the clamping block is clamped in the third clamping slot; the clamping block is detachably clamped with the third clamping slot; or a back portion of the water outlet head is provided with more than one clamping block; the grip is provided with a third clamping slot corresponding to the clamping block; the clamping block is clamped in the third clamping slot; and the clamping block is detachably clamped with the third clamping slot.

Further, the clamping block is trapezoidal; the clamping block is provided with a first inclined plane and a second inclined plane; the first inclined plane and the second inclined plane are opposite to each other; and the first inclined plane is arranged in a direction of the third clamping slot.

Further, the water pumping component includes a first control circuit board, a battery, a temperature probe, and a display screen; the first wire, the battery, the temperature probe, and the display screen are all electrically connected to the first control circuit board; the first control circuit board, the battery, and the display screen are all arranged in the first waterproof integrated box; the temperature probe is arranged on an outer side of the first waterproof integrated box; and a temperature detected by the temperature probe is transmitted to the display screen through the first control circuit board, so that the display screen displays temperature information detected by the temperature probe.

Further, the water pumping component further includes a water pump; the water pump is arranged on the outer side of the first waterproof integrated box; a first opening B is arranged on the first waterproof integrated box; a first waterproof sleeve B is arranged at the first opening B; the first waterproof sleeve B seals the first opening B; the water pump is electrically connected to the first control circuit board through a second wire; one end of the second wire is connected to the first control circuit board, and an opposite end of the second wire is connected to the water pump through the first waterproof sleeve B; and an inner wall of a through hole of the first waterproof sleeve B compresses the second wire.

Further, a first display region is arranged on the first shell; a second display region corresponding to the first display region is arranged on the first waterproof integrated box; and a display surface of the display screen corresponds to the first display region and the second display region, so that the display screen achieves displaying through the second display region and the first display region.

Beneficial effects of the present disclosure are as follows: The present disclosure provides a water toy. The first waterproof integrated box is designed to be a sealed, waterproof, and easily removable structure, which facilitates mounting and repair of the electronic element. The water toy is also designed with the temperature display screen, so that parents can monitor a water temperature in real time when their child plays with the water toy; and the water volume control switch is designed, which improves the fun of playing with the water toy.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

REFERENCE NUMERALS

Figure 1:
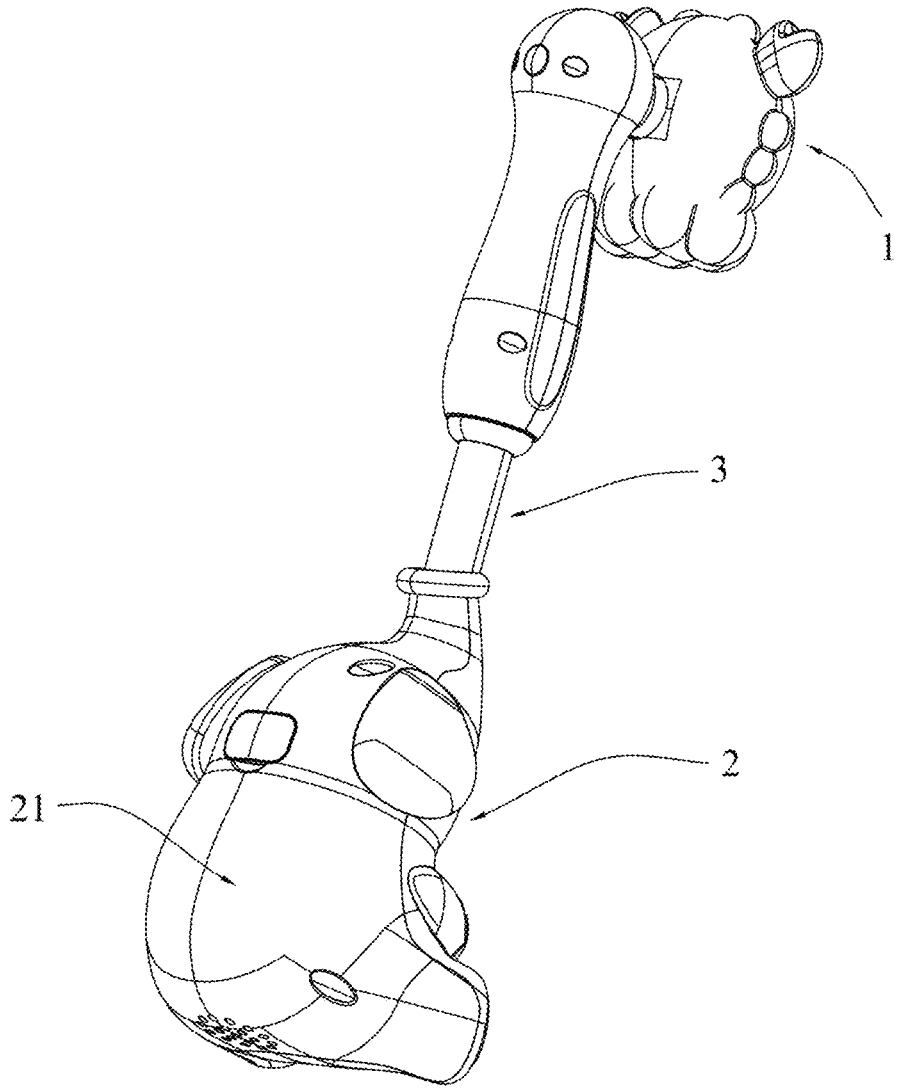
FIG. 1 is a perspective view of a water toy according to the present disclosure.

Water outlet device 1; grip 11; clamping block 111; first inclined plane 1111; second inclined plane 1112; bayonet 112; hollow guide column 113; surrounding wall 114; second shell 115; second waterproof integrated box 116; second opening A 1161; second opening B 1162; sealing ring 1163; second waterproof sleeve 117; water outlet head 12; third clamping slot 121; mounting slot 122; positioning sliding block 123; hollow positioning column 124; water toy main body 2; first shell 21; first display region 2111; first waterproof integrated box 22; first upper shell 221; protrusion 2211; first lower shell 222; groove 2221; second display region 224; first opening A 225; first waterproof sleeve A 226; first opening B 227; first waterproof sleeve B 228; sealing member 24; clasp 231; second connecting component 3; water pipe 31; protective pipe 32; first connecting fixing member 33; first clamping slot 331; first fastener 34; second connecting fixing member 35; second clamping slot 351; second fastener 36; second wire 5; water volume control switch 4; control button 41; sensing element 411; second control circuit board 42; first wire 6; water pumping component 7; water pump 71; third waterproof sleeve 711; first control circuit board 72; battery 73; temperature probe 74; display screen 75.

DETAILED DESCRIPTION OF THE EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Embodiment One

Referring to FIGS. 1-13, a water toy is provided in the present disclosure. The water toy includes a first shell. The first shell includes a chamber 101211 configured for accommodating water and a first waterproof integrated box positioned in the chamber. The first shell is provided with a water inlet 1001 and a water outlet 1002. The water inlet, the chamber, and the water outlet are in communication with each other. The first waterproof integrated box is configured for accommodating an electronic element. The first waterproof integrated box includes a first upper shell, a first lower shell, a sealing member, and a waterproof chamber. The first upper shell and the first lower shell are connected to each other. The sealing member is arranged at mounting ports of the first upper shell and the first lower shell. After the first upper shell and the first lower shell are connected to each other, the sealing member seals a gap between the first upper shell and the first lower shell to form the waterproof chamber. The water toy also includes a water pumping component 7 and a water toy main body. The water toy main body also includes the first shell 21. The first waterproof integrated box 22 and the water pumping component 7 are arranged inside the first shell 21. The pumping component is used for driving the water inside the chamber to be sprayed out through the water outlet. Specifically, the water toy further includes a water outlet device 1 and a second connecting component 3. The water outlet device 1 includes a water outlet head 12. The water outlet head 12 of the water outlet device 1 is in communication with the water outlet of the first shell. The water pumping component is used for driving the water in the chamber to pass through the water outlet and the water outlet head in sequence and to be sprayed out from the water outlet head. Furthermore, the first waterproof integrated box 22 further includes a mounting channel 10111, and the water toy further includes a first conductive terminal 104. A first end of the first conductive terminal 104 is electrically connected to the electronic element inside the first waterproof integrated box 22, and a second end of the first conductive terminal 104 is exposed from the first waterproof integrated box 22 through the mounting channel 10111. The water toy also includes a second conductive terminal 105. A first end of the second conductive terminal 105 is electrically connected to the electronic element inside the first waterproof integrated box 22, and a second end of the second conductive terminal 105 is exposed from the first waterproof integrated box 22 through the mounting channel 10111. A gap is provided between the second end of the second conductive terminal 105 and the second end of the first conductive terminal 104, and the second end of the second conductive terminal 105 and the second end of the first conductive terminal 104 can be mutually conductive through a conductive medium. Furthermore, the mounting channel 10111 includes a seventh opening 1062 and a fourth opening 1063 both positioned in the first waterproof integrated box. The seventh opening 1062 and the fourth opening are spaced apart from each other. The second end of the first conductive terminal 104 is exposed from the first waterproof integrated box 22 through the seventh opening 1062, and the second end of the second conductive terminal 105 is exposed from the first waterproof integrated box 22 through the fourth opening 1063. Through the above structure, when the water toy is placed in water, the second end of the second conductive terminal and the second end of the first conductive terminal can be mutually conductive through the conductive medium in the water to activate a driving device, so that the driving device drives the water to pass through the water inlet, the chamber, and the water outlet in sequence, and to be sprayed out from the water outlet for children to play with. Moreover, when the driving device drives the liquid to pass through the water inlet and the water outlet in sequence and to be sprayed out from the water outlet, a reaction force generated when the water is driven will push the first shell to drift in the water, thereby enhancing the fun and ornamental value of the water toy.

It should be explained that compared with the U.S. Pat. No. 8,315,040B2 which mentions "A protective enclosure comprising: a base comprising a first continuous mating surface and at least one conveyance aperture configured for passage between the inside of the enclosure and the outside of the enclosure of at least one conveyance, wherein the at least one conveyance comprises one or more wires separated from immediate surroundings and preventing passage of contaminants past or between the one or more wires by electrical insulation material encasing the one or more wires;

a cover comprising a second continuous mating surface, wherein the second continuous mating surface is configured to form a seal with the first continuous mating surface; and a clamp comprising a mouth having an upper mouth portion and a lower mouth portion, wherein at least a portion of the clamp is coupleable to the base, wherein the mouth of the clamp is configured to be offset from the aperture when the clamp is coupled to the base, wherein the clamp further comprises a first seal having at least a portion compressed by the upper mouth portion and the lower mouth portion within the mouth of the clamp, and wherein the first seal is configured with one or more flexible surfaces to conform around at least a portion of opposite sides of the at least one conveyance traversing the mouth to seal the aperture against contaminants.", the first waterproof integrated box in the present application is placed in the chamber of the first shell. The waterproof chamber of the first waterproof integrated box in the present application is used for placing electronic elements that supply power to the water toy and control the water spray of the water toy, and water is prevented from entering the waterproof chamber of the first waterproof integrated box, thereby preventing short circuits in the electronic elements that supply power to the water toy and control the water spray of the water toy, allowing the driving device to drive water to pass through the water inlet, the chamber, and the water outlet in sequence and to be sprayed out from the water outlet for children to play with. However, the protective enclosure in the U.S. Pat. No. 8,315,040B2 only prevents water from entering the protective enclosure of a remote control vehicle. The U.S. Pat. No. 8,315,040B2 does not mention the technical solution of placing the first waterproof integrated box in the first shell equipped with the water inlet and the water outlet, nor does it mention the technical solution of "The waterproof chamber of the first waterproof integrated box is used for placing electronic elements that supply power to the water toy and control the water spray of the water toy, and water is prevented from entering the waterproof chamber of the first waterproof integrated box, thereby preventing short circuits in the electronic elements that supply power to the water toy and control the water spray of the water toy, allowing the driving device to drive water to pass through the water inlet, the chamber, and the water outlet in sequence and to be sprayed out from the water outlet for children to play with.". Therefore, the present application is completely different from the solution mentioned in the U.S. Pat. No. 8,315,040B2.

Figure 2:
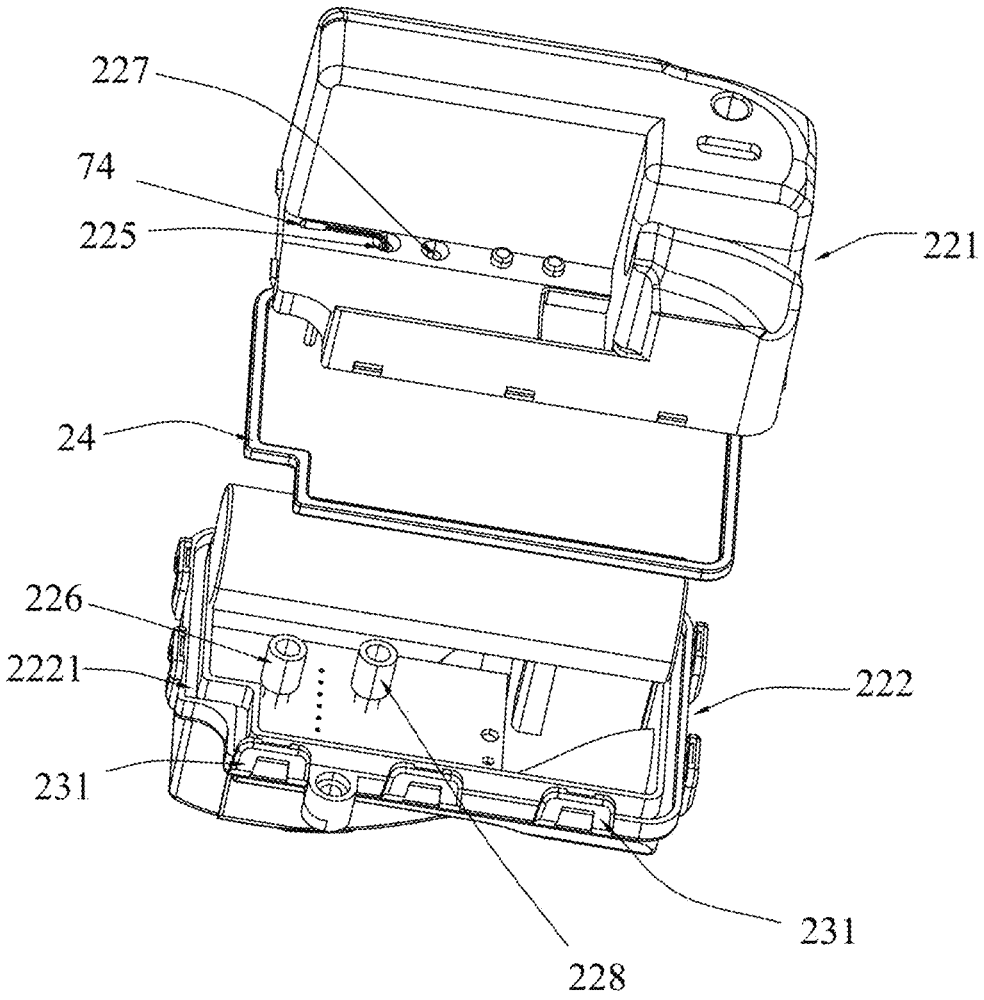
FIG. 2 is an exploded view of a first waterproof integrated box according to the present disclosure.

As shown in FIG. 2, the water toy includes a water toy main body 2; the water toy main body 2 includes a first waterproof integrated box 22; the first waterproof integrated box 22 is configured to accommodate an electronic element; the first waterproof integrated box 22 includes a first upper shell 221, a first lower shell 222, a sealing member 24, and a waterproof chamber; the first upper shell 221 and the first lower shell 222 are covered with each other; the sealing member 24 is arranged at mounting ports of the first upper shell 221 and the first lower shell 222; after the first upper shell 221 and the first lower shell 222 are covered with each other, the sealing member 24 seals a gap between the first upper shell 221 and the first lower shell 222 to form the waterproof chamber; and the first upper shell 221 and the first lower shell 222 are detachably connected through a clasp 231.

In terms of the structure of the first waterproof integrated box 22, since children have no awareness of protecting the toy when playing with the toy, the toy is easy to damage, and the damage to the toy is possibly caused by an electronic element or poor connection and contact of a circuit. The first waterproof integrated box 22 adopts the detachable design using the clasp, so that it is convenient to open the first waterproof integrated box 22 to repair the electronic element and the circuit. For example, if the first upper shell 221 and the first lower shell 222 are sealed using a screw, a bolt, or other fixing methods, it is inconvenient for assembling and disassembling; it takes time to perform assembling and disassembling; and it is inconvenient to repair the electronic element inside the first waterproof integrated box 22. Therefore, the clasp design is more convenient for assembling and disassembling. The sealing member 24 seals the gap between the first upper shell 221 and the first lower shell 222 after the first upper shell and the first lower shell are covered with each other to achieve a waterproof effect, and the waterproof chamber is formed in the first waterproof integrated box 22 to avoid water from entering the first waterproof integrated box and protect the electronic element.

The above clasp can include more than one first clasp member 231 and first clamping position 232. The first clasp member 231 is arranged on a periphery of the first upper shell 221; the first clamping position 232 is arranged on a periphery of the first lower shell 222; the first clamping position 232 corresponds to the first clasp member 231; the first clasp member 231 is clamped to the first clamping position 232 to connect the first upper shell 221 with the first lower shell 222; or, the first clasp member 231 is arranged on a periphery of the first lower shell 222; the first clamping position 232 is arranged on a periphery of the first upper shell 221; the first clamping position 232 corresponds to the first clasp member 231; and the first clasp member 231 is clamped to the first clamping position 232 to connect the first upper shell 221 with the first lower shell 222.

Figure 3:
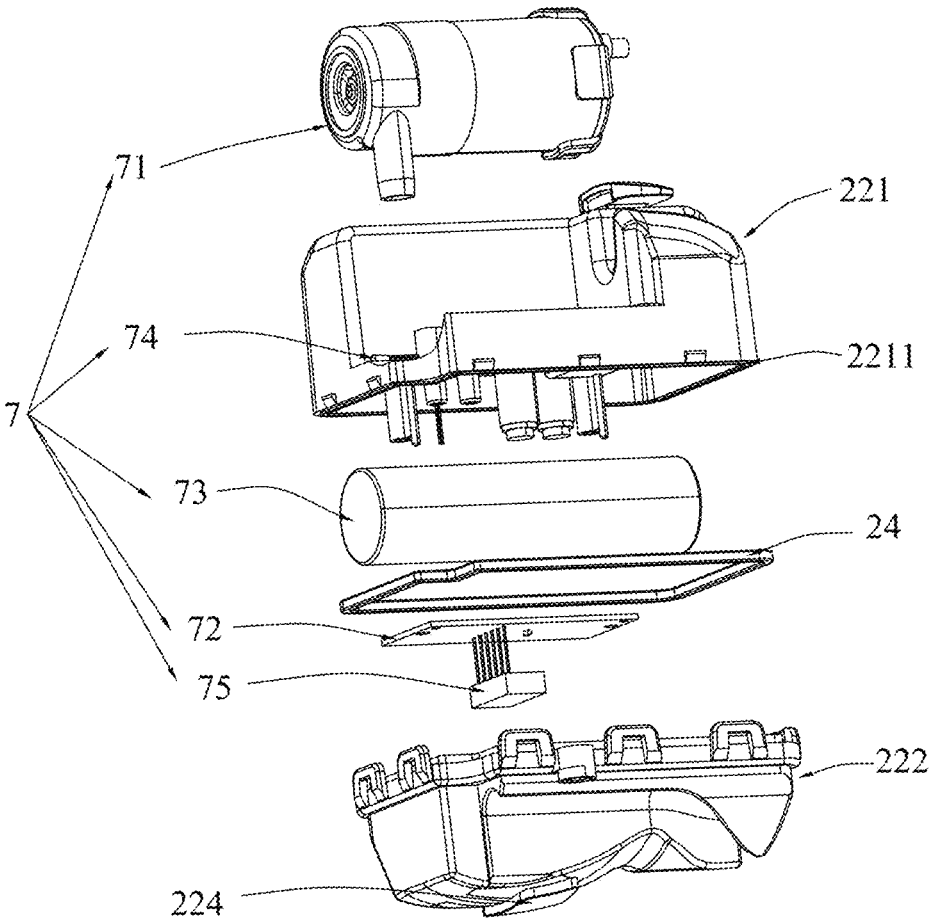
FIG. 3 is an exploded view of a first waterproof integrated box according to the present disclosure.

In this embodiment, as shown in FIG. 3, a groove 2221 is arranged on the first lower shell 222; the sealing member 24 is arranged in the groove 2221; the first upper shell 221 is provided with a protrusion 2211; the protrusion 2211 is inserted into the groove 2221 and compresses the sealing member 24, so that the first upper shell 221 and the first lower shell 222 are hermetically connected to each other; or a groove 2221 is arranged on the first upper shell 221; the sealing member 24 is arranged in the groove 2221; the first lower shell 222 is provided with a protrusion 2211; and the protrusion 2211 is inserted into the groove 2221 and compresses the sealing member 24, so that the first upper shell 221 and the first lower shell 222 are hermetically connected to each other. By the arrangement of the groove 2221 that accommodates the sealing member 24, the protrusion 2211 compresses the sealing member 24, so that the waterproof chamber in the first waterproof integrated box 22 has higher waterproof performance. When children plays with the water toy, water will not seep into the waterproof chamber, which better improves the waterproof performance and improves the quality of the water toy. The sealing member 24 here can use a sealing ring, plastic, or rubber. The sealing ring is preferred because it is convenient to mount. The sealing ring preferably adopts, but is not limited to, a SIL silicone rubber sealing ring or a soft silicone sealing ring. The sealing ring can be set according to a requirement of a manufacturer as long as it mainly achieves a sealing effect.

An inner side edge of the groove 2221 is preferably higher than an outer side edge of the groove 2221. Firstly, this setting facilitates the covering of the first upper shell 221 and the first lower shell 222. Secondly, this setting provides better waterproofing performance.

Figure 4:
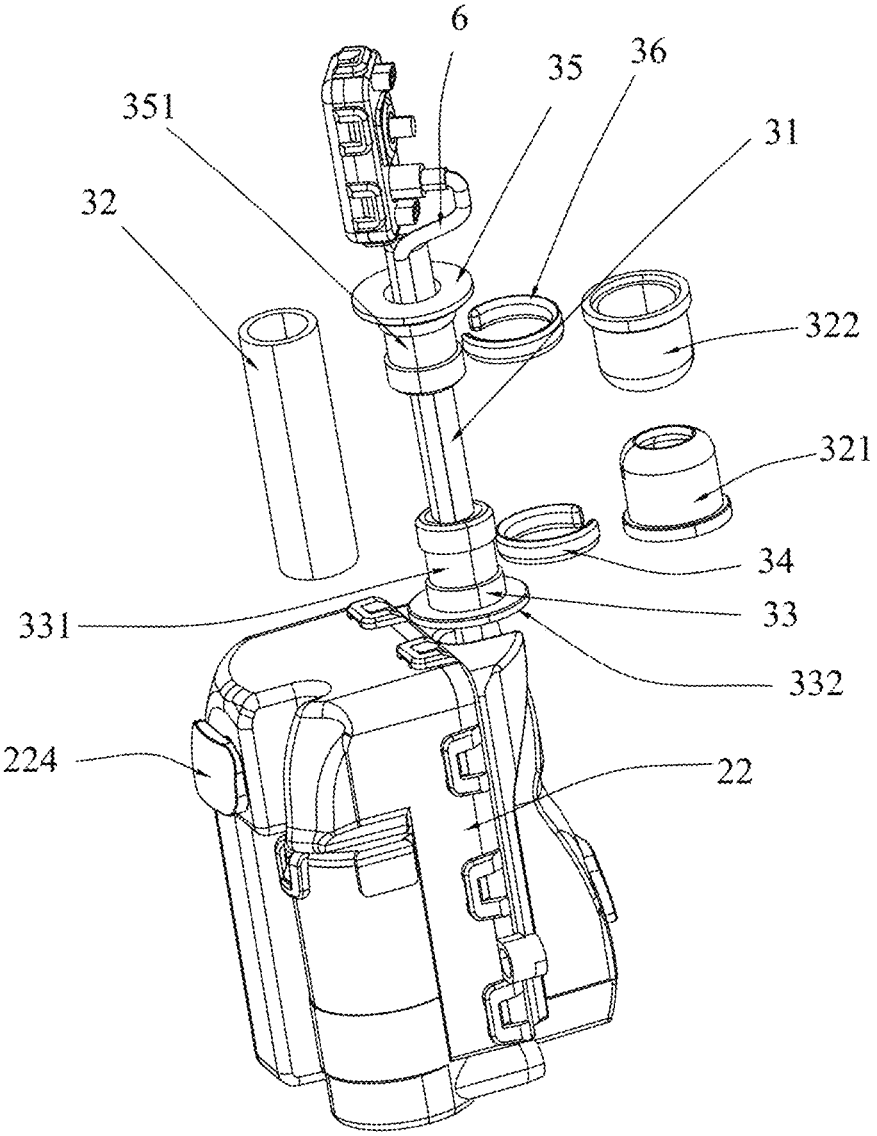
FIG. 4 is a schematic diagram of an internal structure of a water toy according to the present disclosure.
Figure 5:
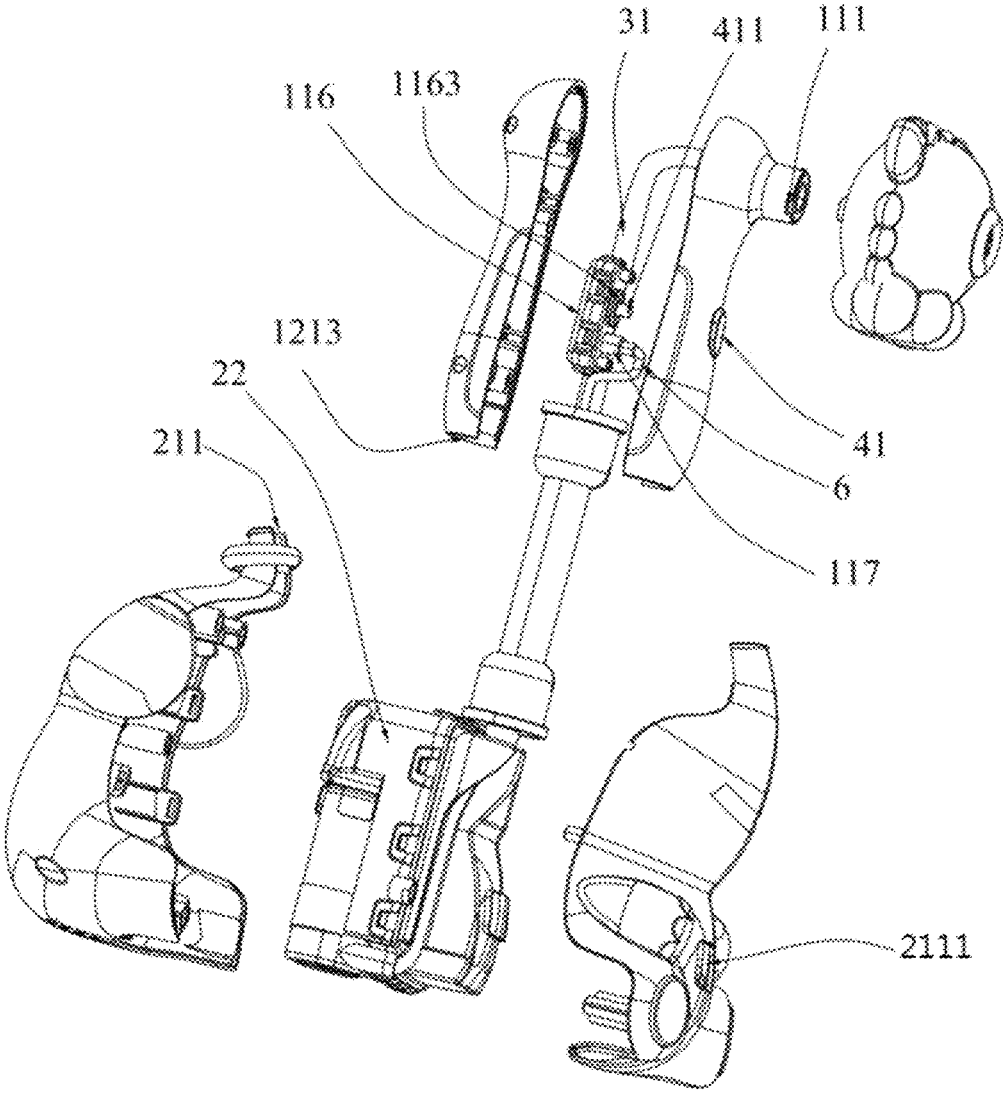
FIG. 5 is an exploded view of a water toy according to the present disclosure.
Figure 6:
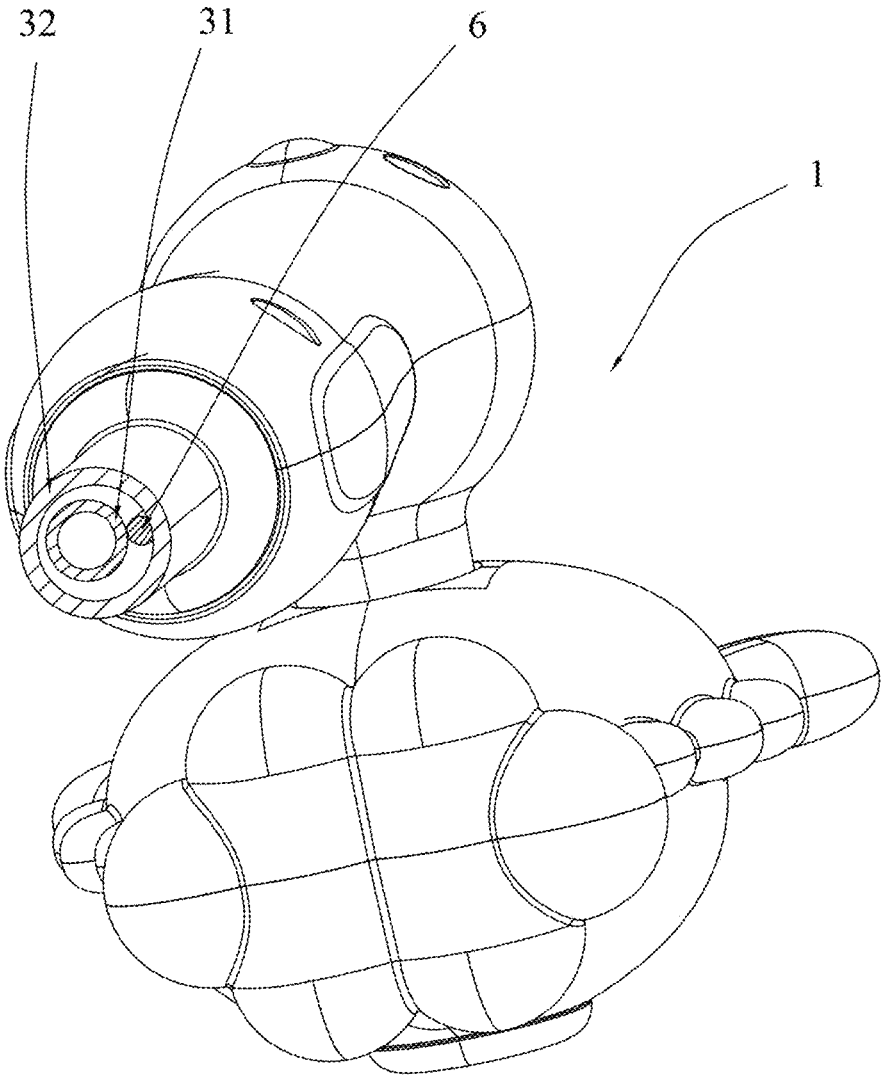
FIG. 6 is a schematic diagram of a mounting structure of a first wire and a second connecting component according to the present disclosure.
Figure 7:
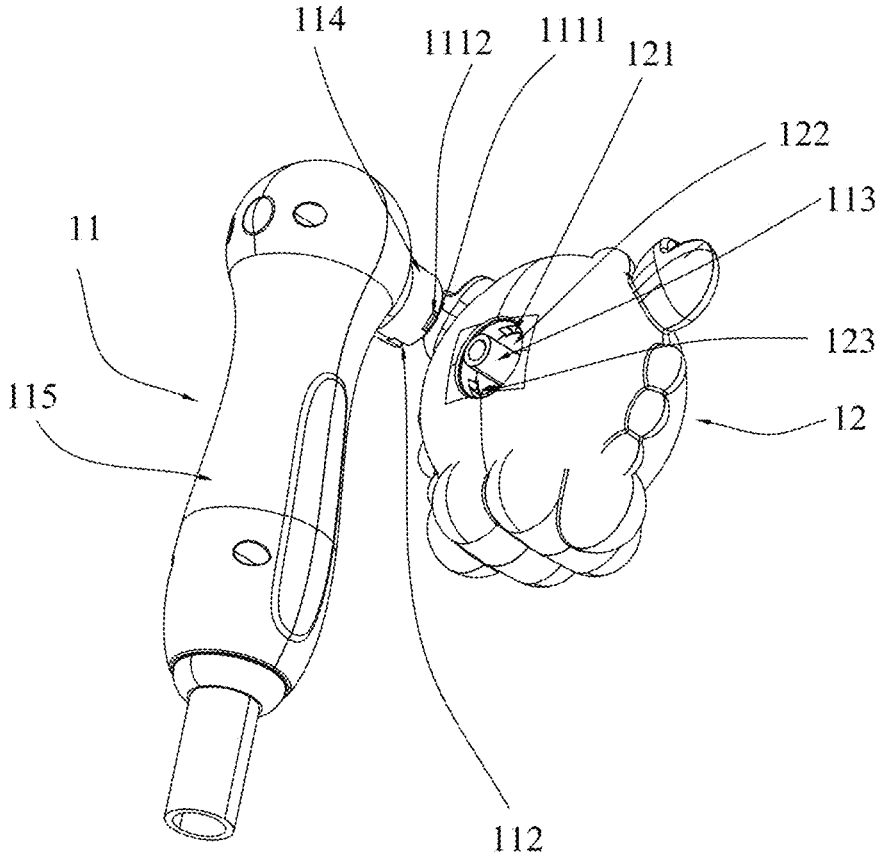
FIG. 7 is a schematic diagram of a connection structure of a water outlet device according to the present disclosure.
Figure 8:
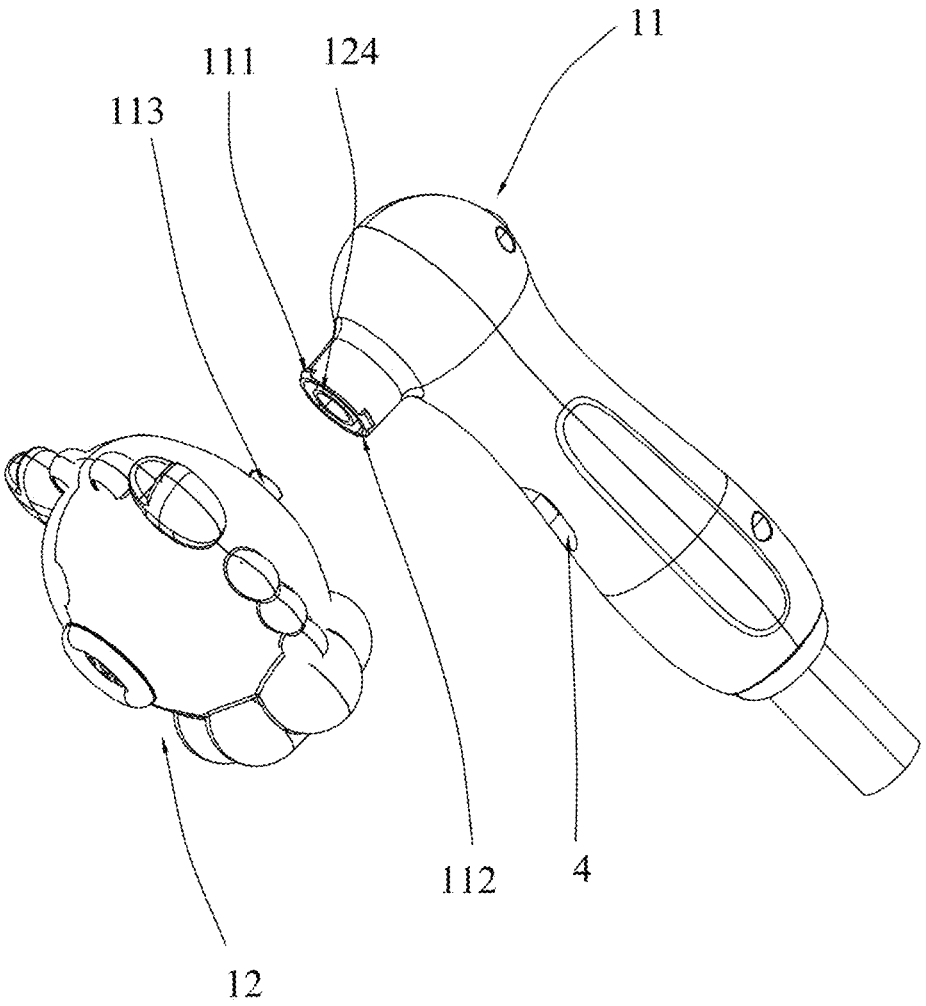
FIG. 8 is a schematic diagram of a connection structure of a water outlet device according to the present disclosure.
Figure 9:
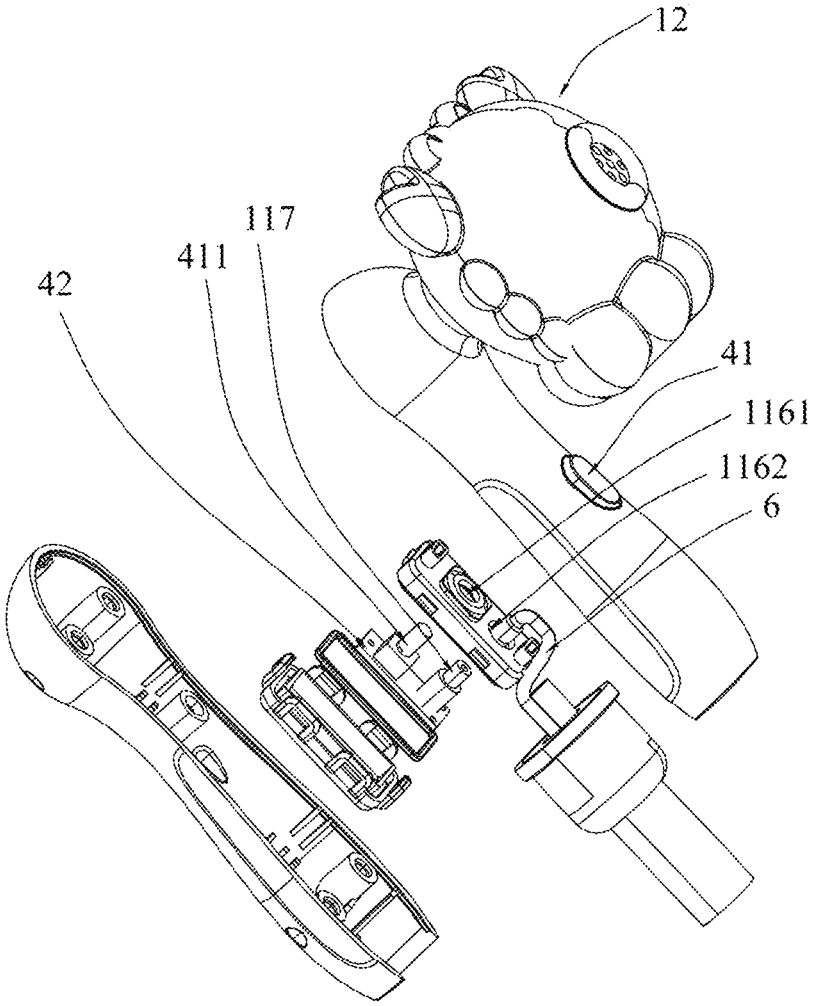
FIG. 9 is an exploded view of a water outlet device according to the present disclosure.
Figure 10:
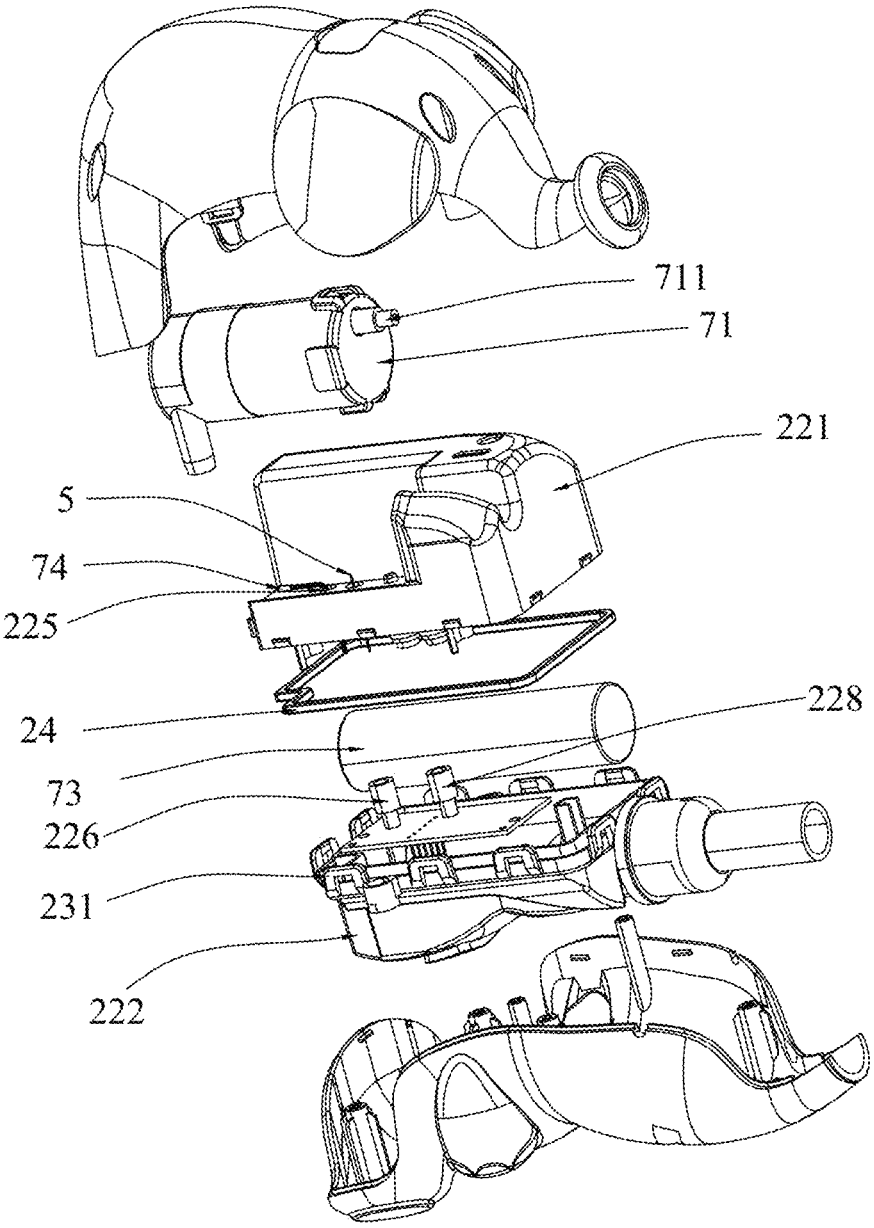
FIG. 10 is an exploded view of a water toy main body according to the present disclosure.
Figure 11:
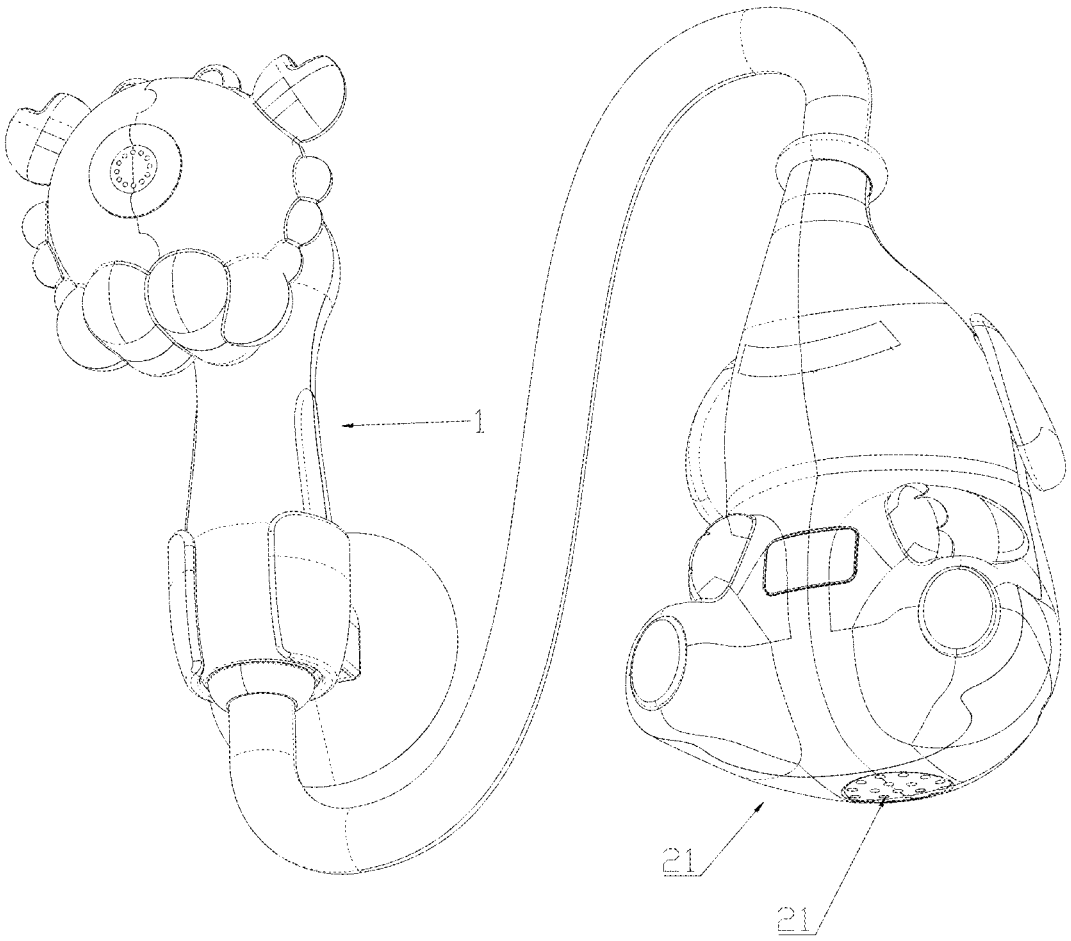
FIG. 11 is another schematic diagram of an overall structure of a water toy according to the present disclosure.
Figure 12:
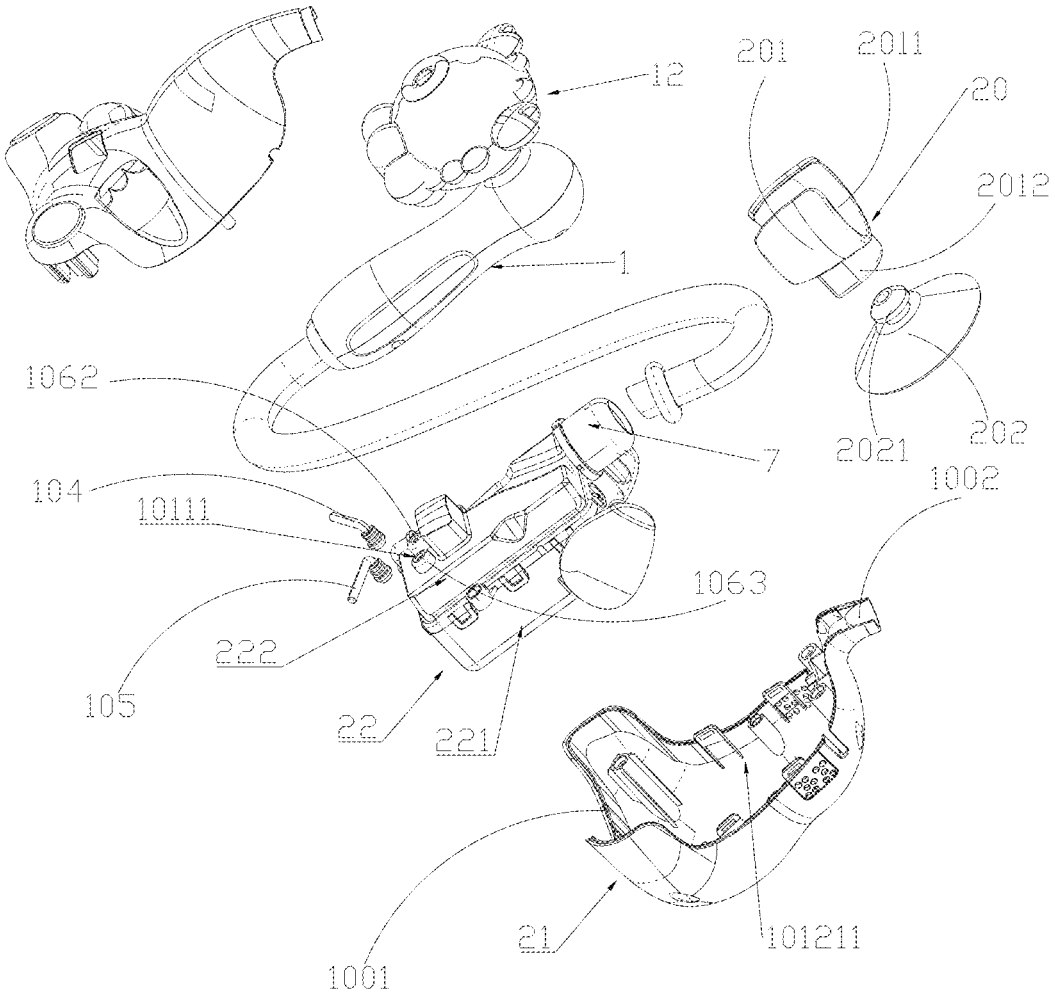
FIG. 12 is another exploded view of a water toy according to the present disclosure.
Figure 13:
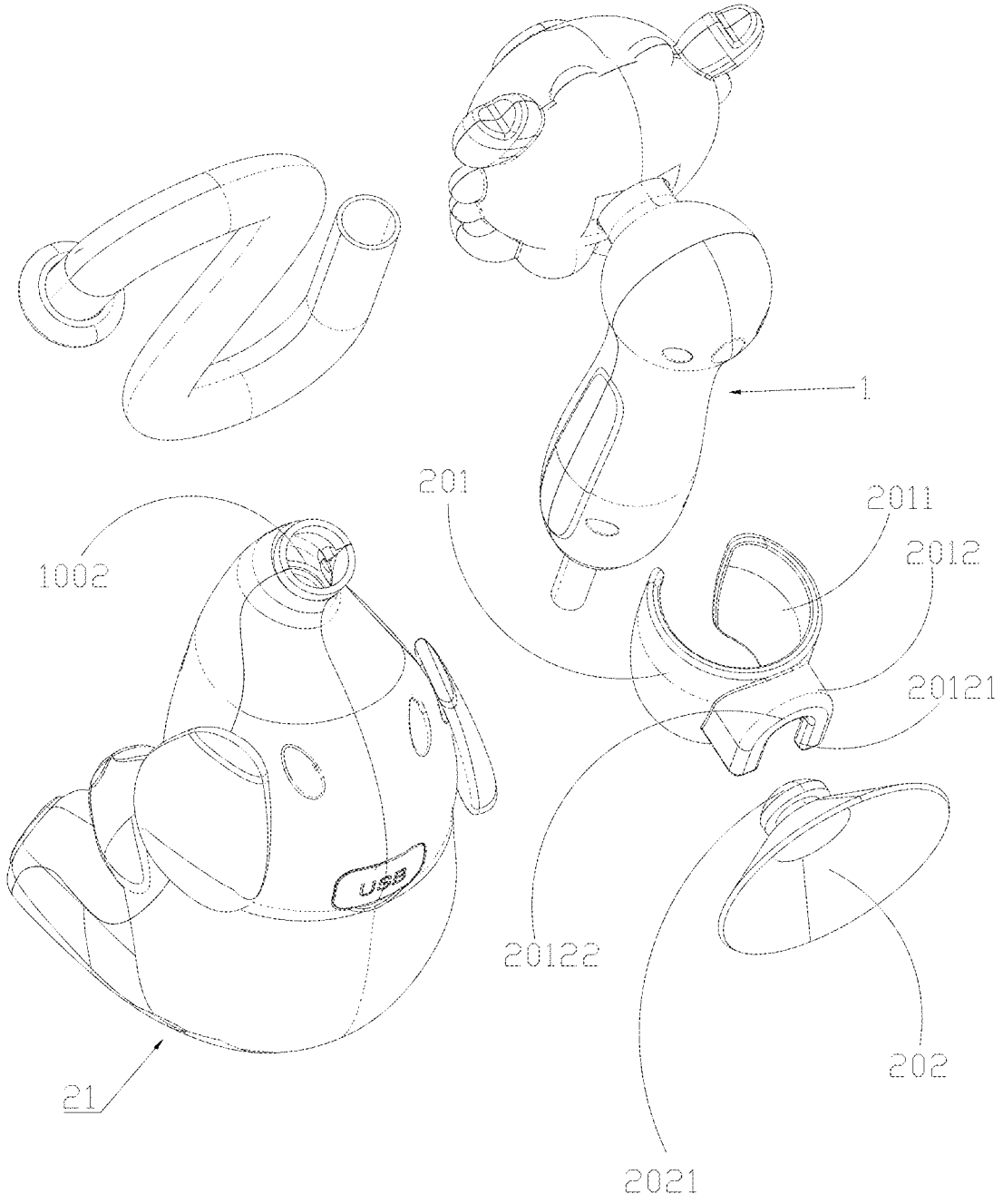
FIG. 13 is another exploded view of a water toy according to the present disclosure.
Figure 14:
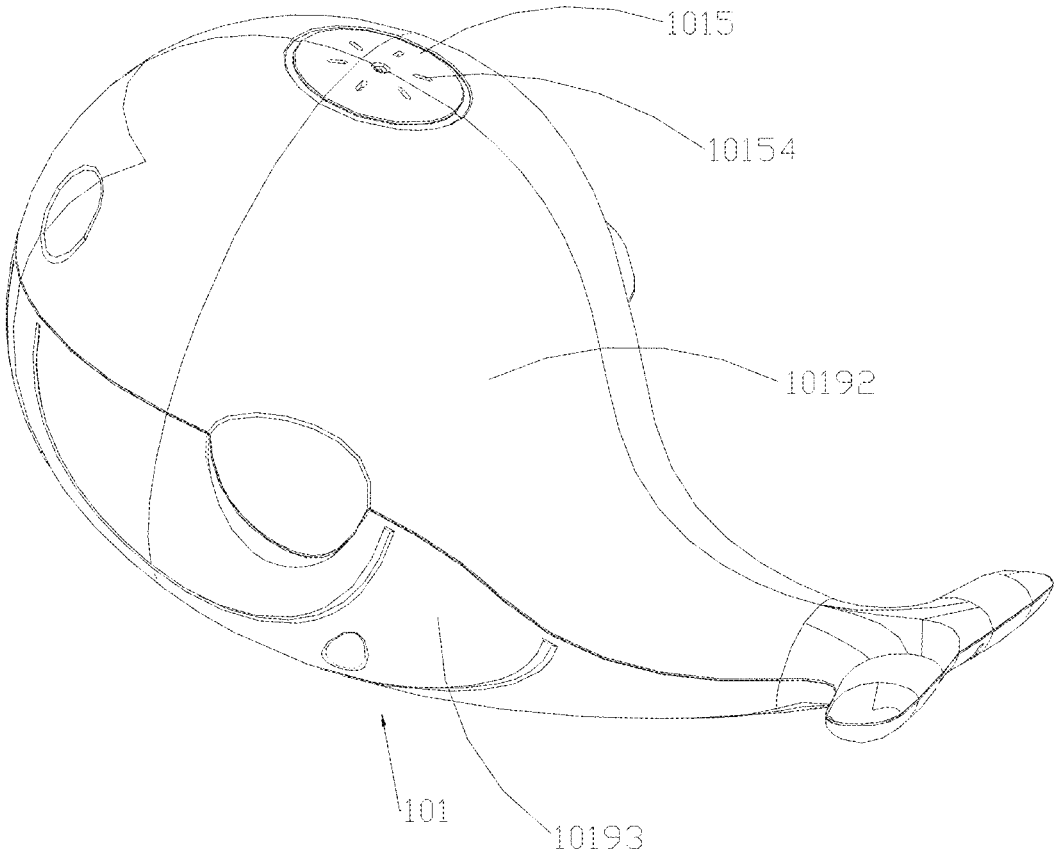
FIG. 14 is another schematic diagram of an overall structure of the present disclosure.
Figure 15:
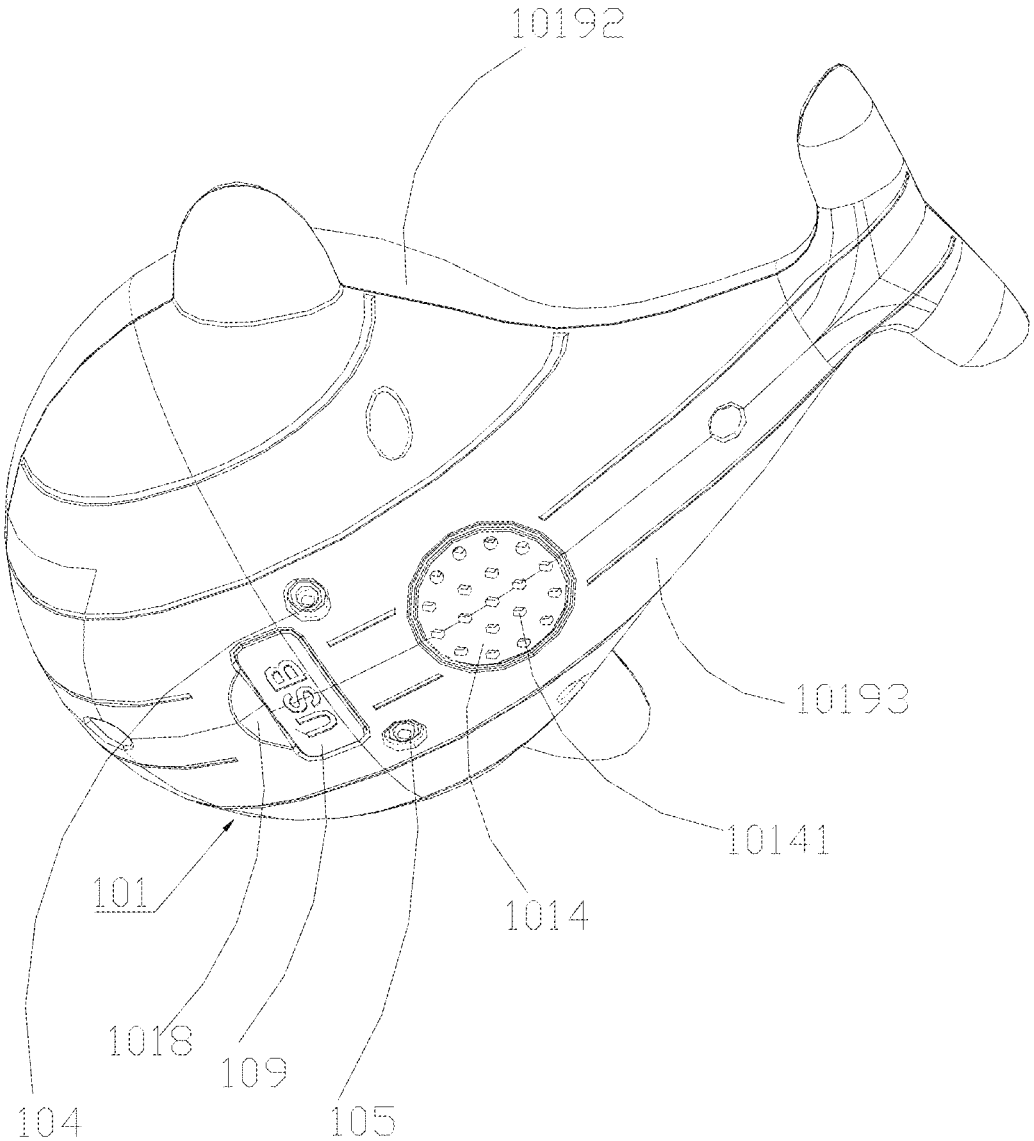
FIG. 15 is another schematic diagram of an overall structure of the present disclosure.
Figure 16:
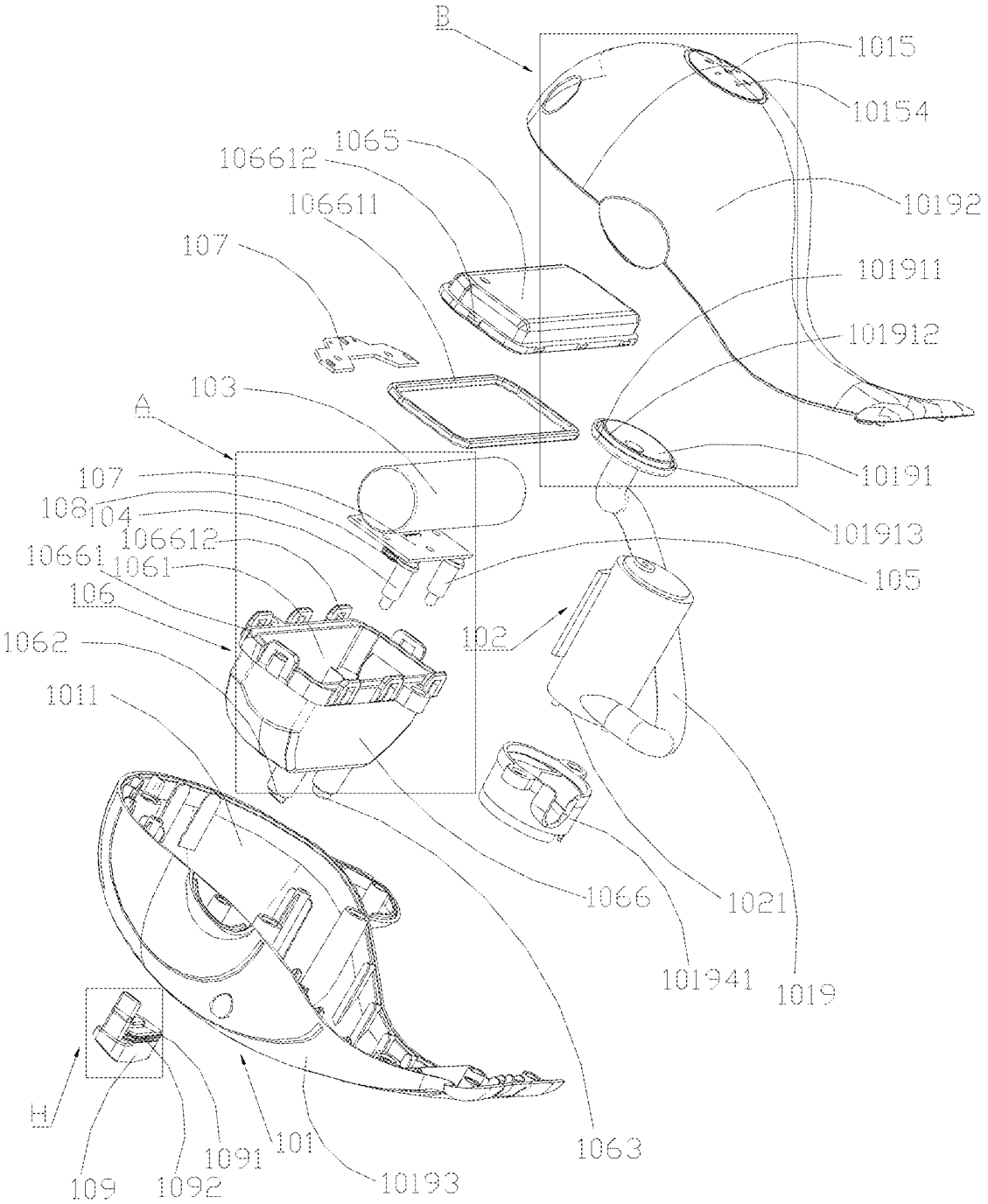
FIG. 16 is an exploded view of the present disclosure.
Figure 17:
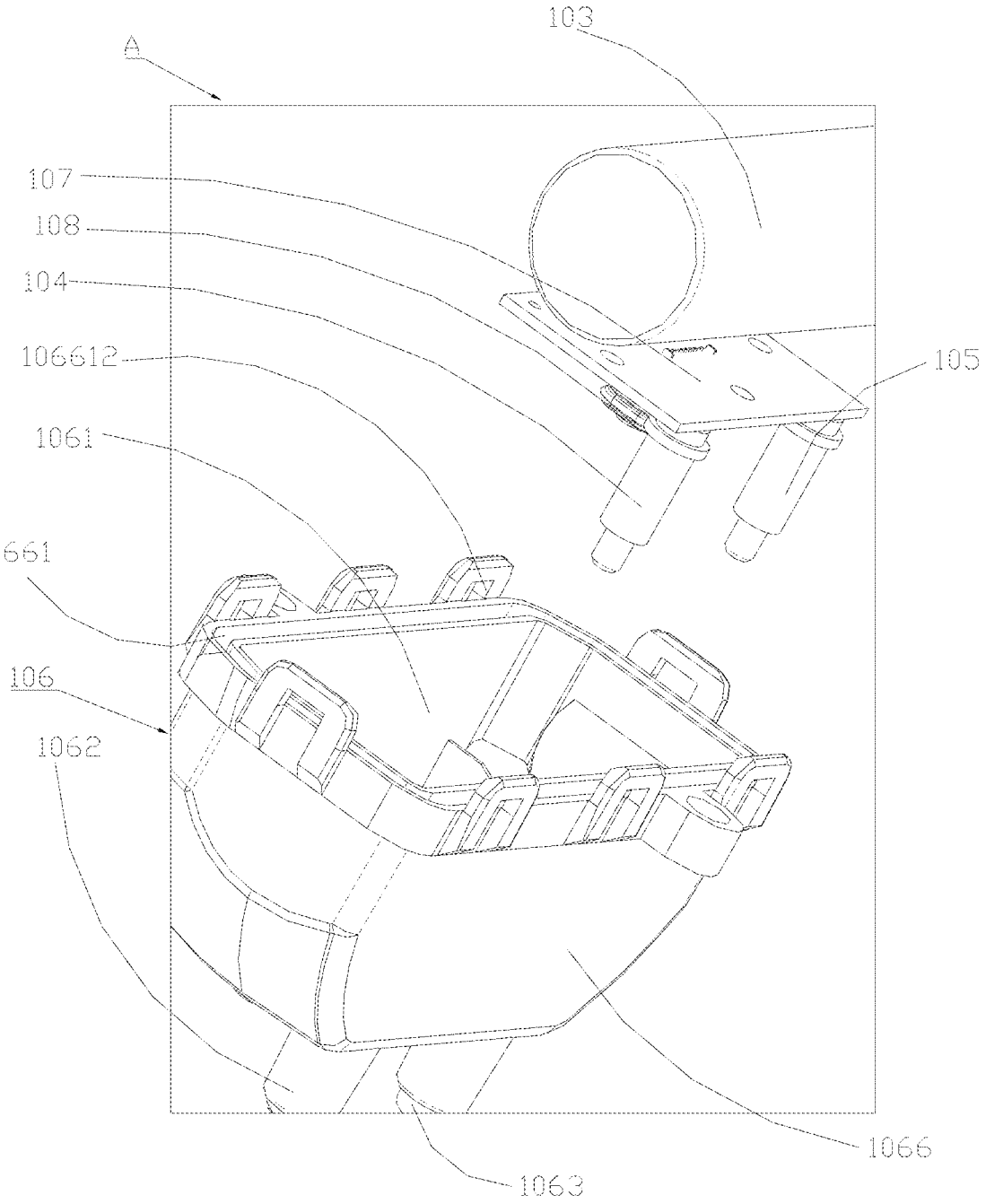
FIG. 17 is an enlarged view of area A in FIG. 16.
Figure 18:
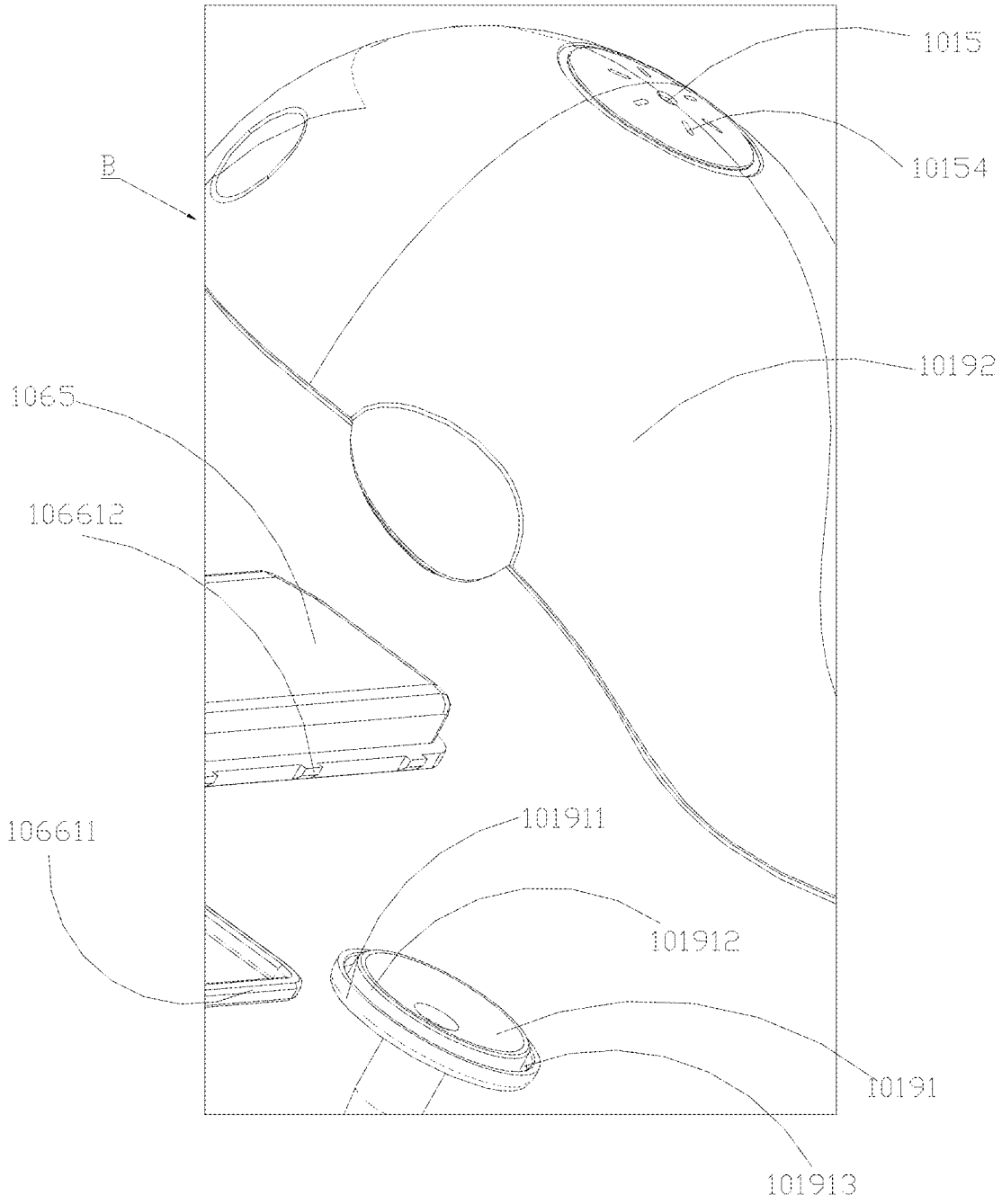
FIG. 18 is an enlarged view of area B in FIG. 16.
Figure 19:
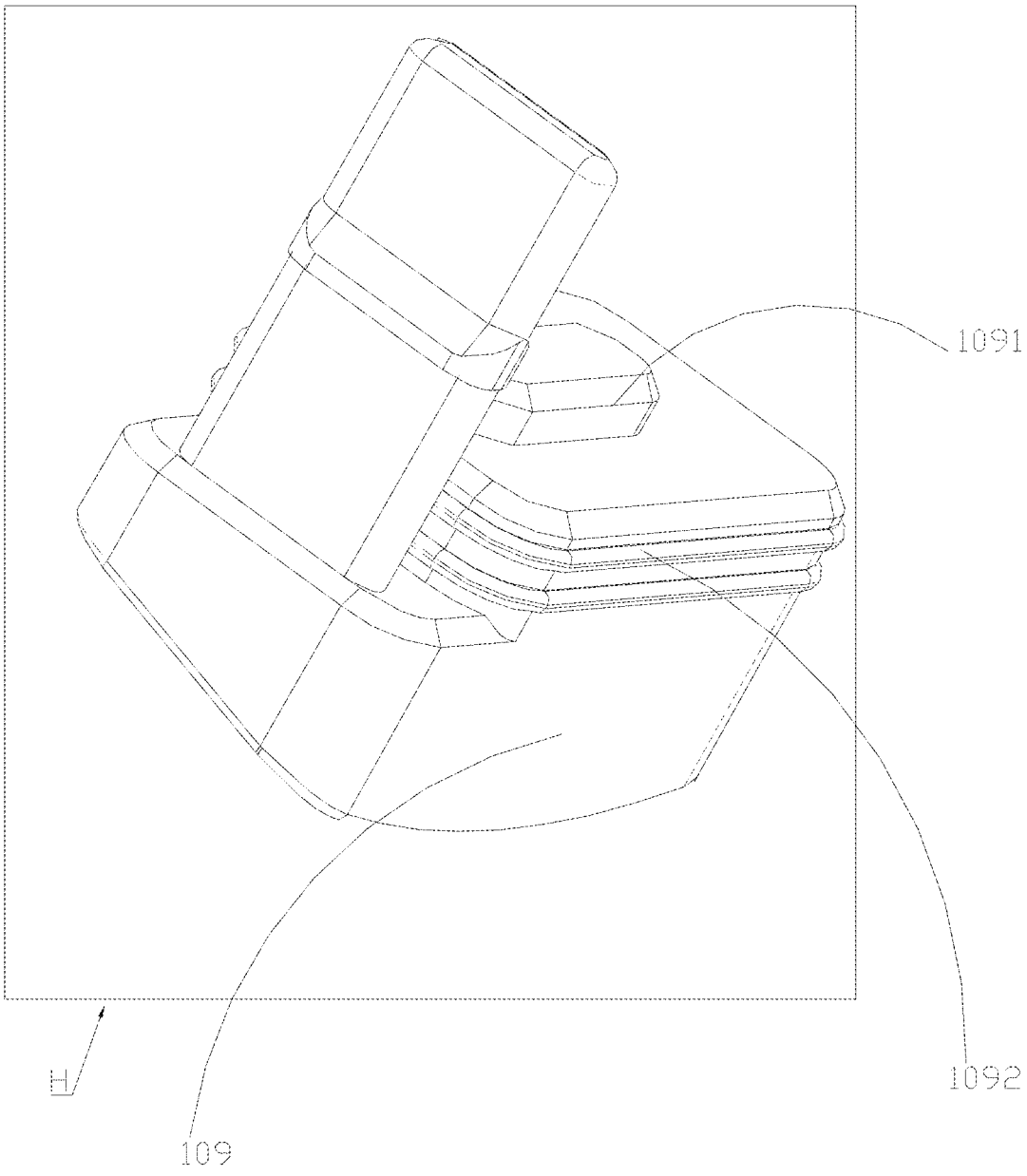
FIG. 19 is an enlarged view of area H in FIG. 16.
Figure 20:
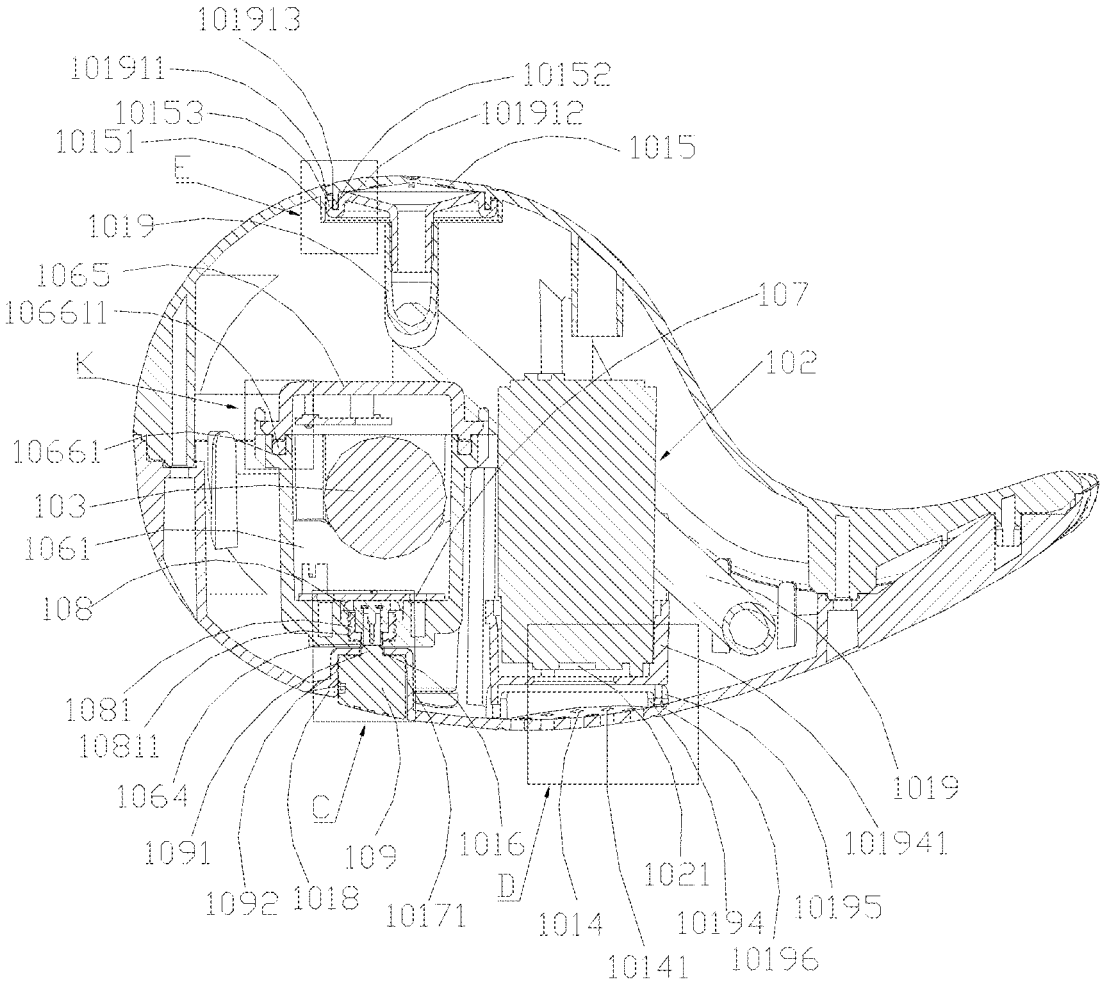
FIG. 20 is a sectional view cut along a sealing plug.
Figure 21:
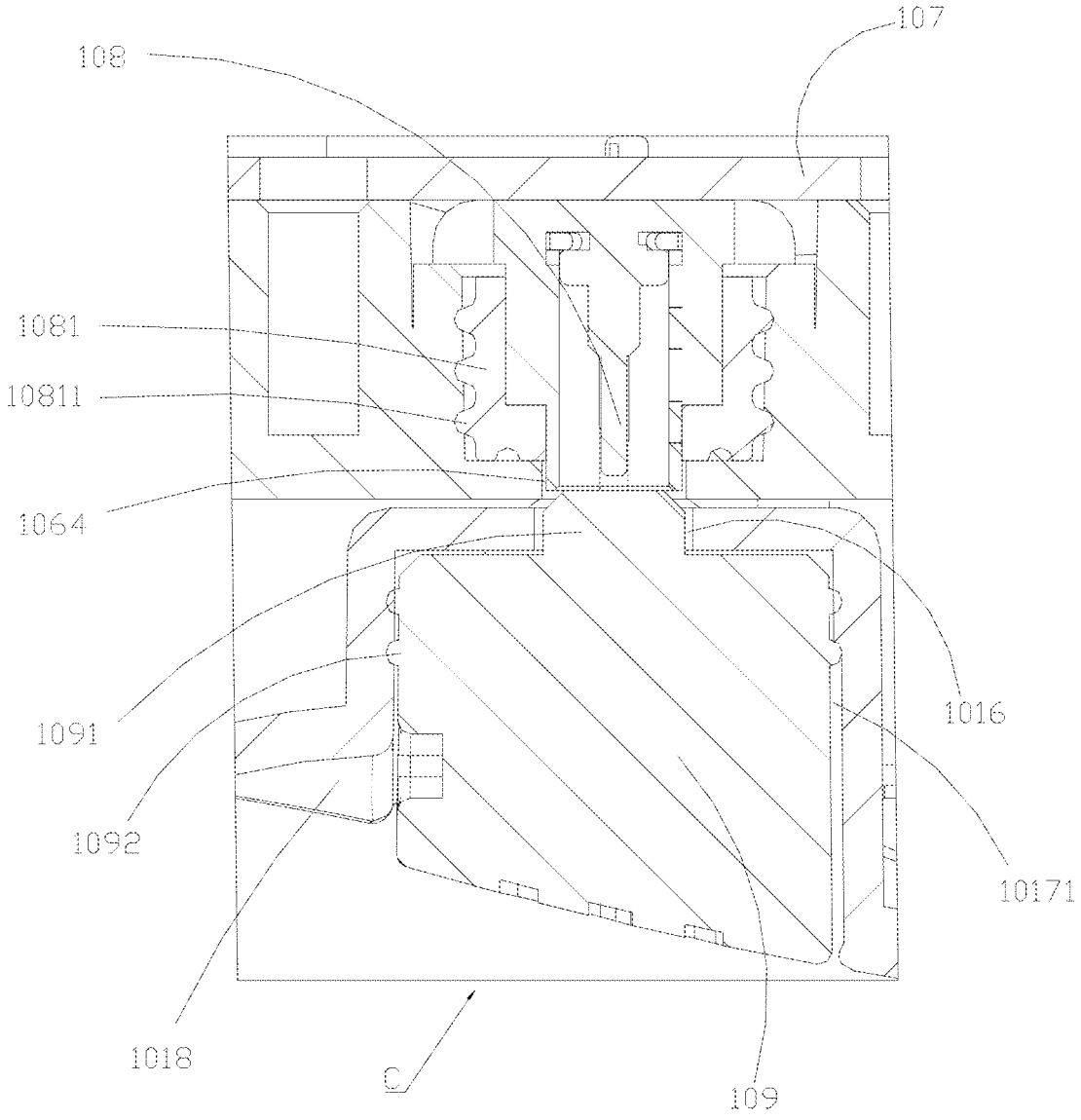
FIG. 21 is an enlarged view of area C in FIG. 20.
Figure 22:
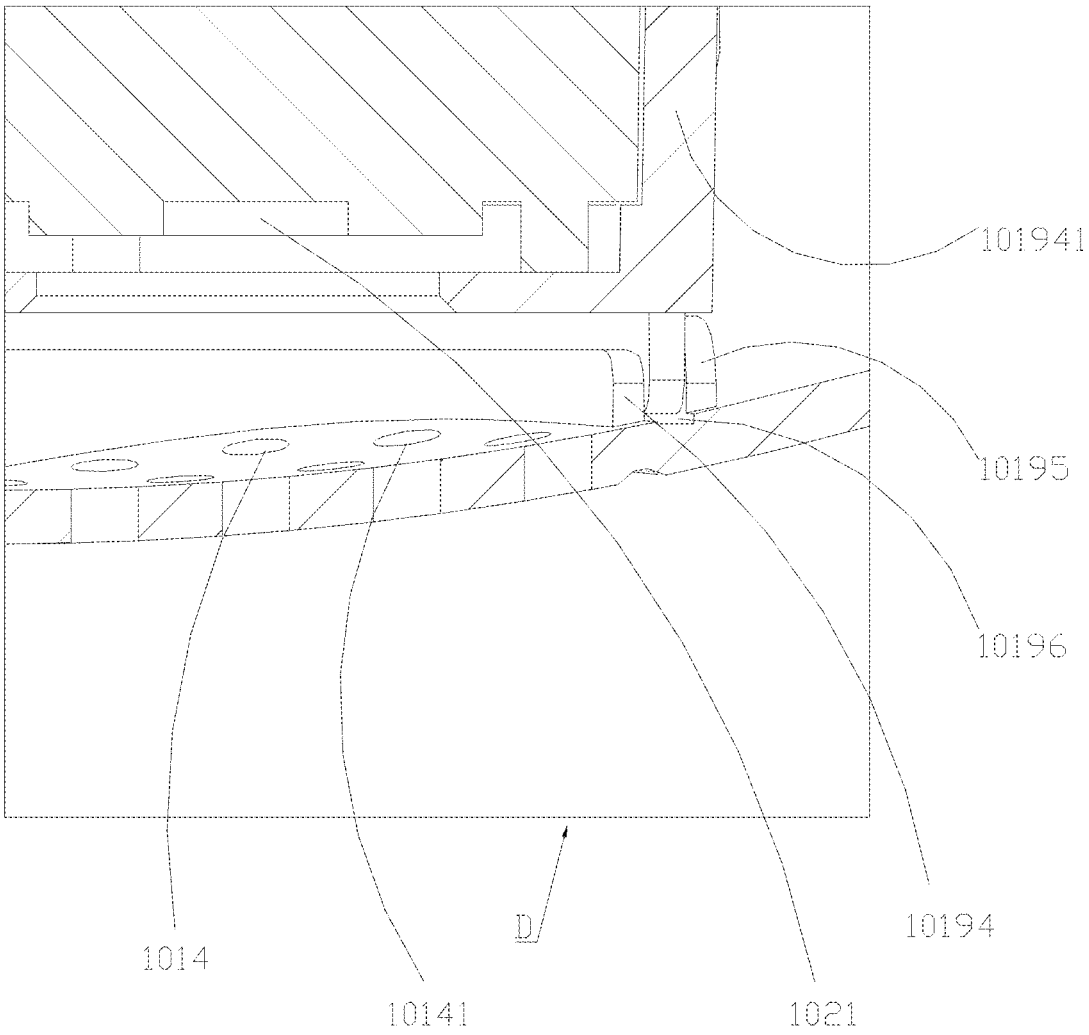
FIG. 22 is an enlarged view of area D in FIG. 20.
Figure 23:
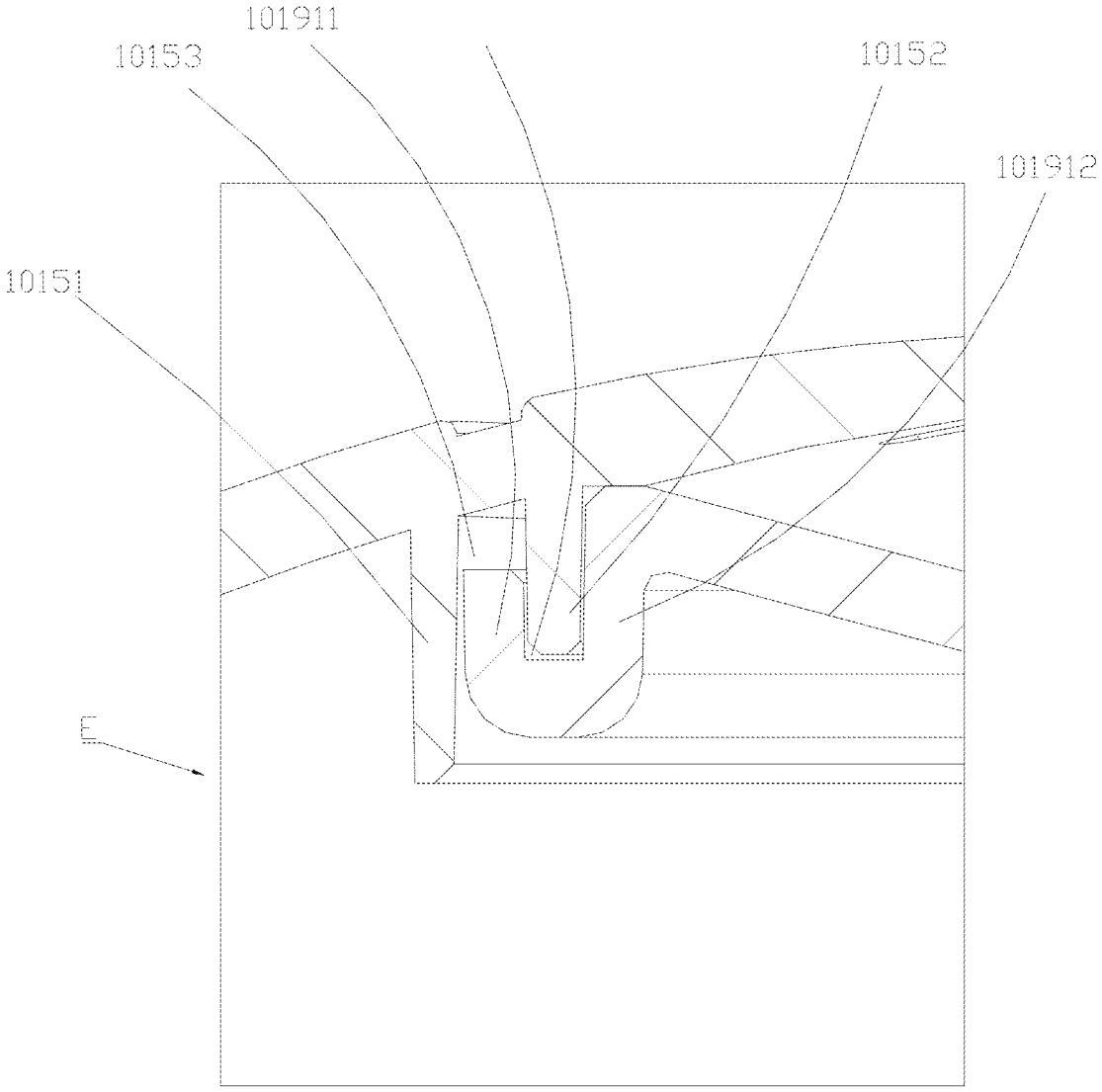
FIG. 23 is an enlarged view of area E in FIG. 20.
Figure 24:
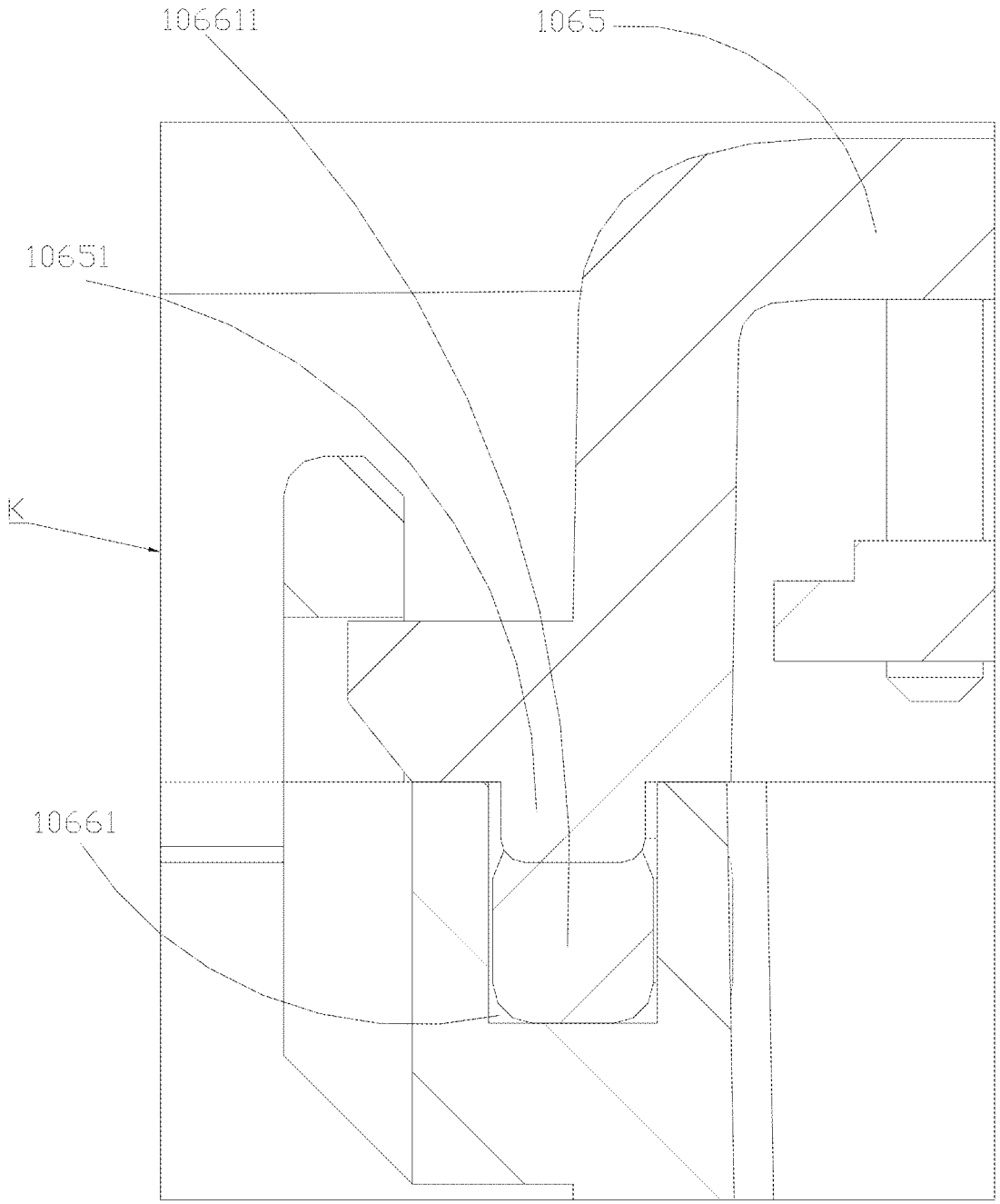
FIG. 24 is an enlarged view of area K in FIG. 20.
Figure 25:
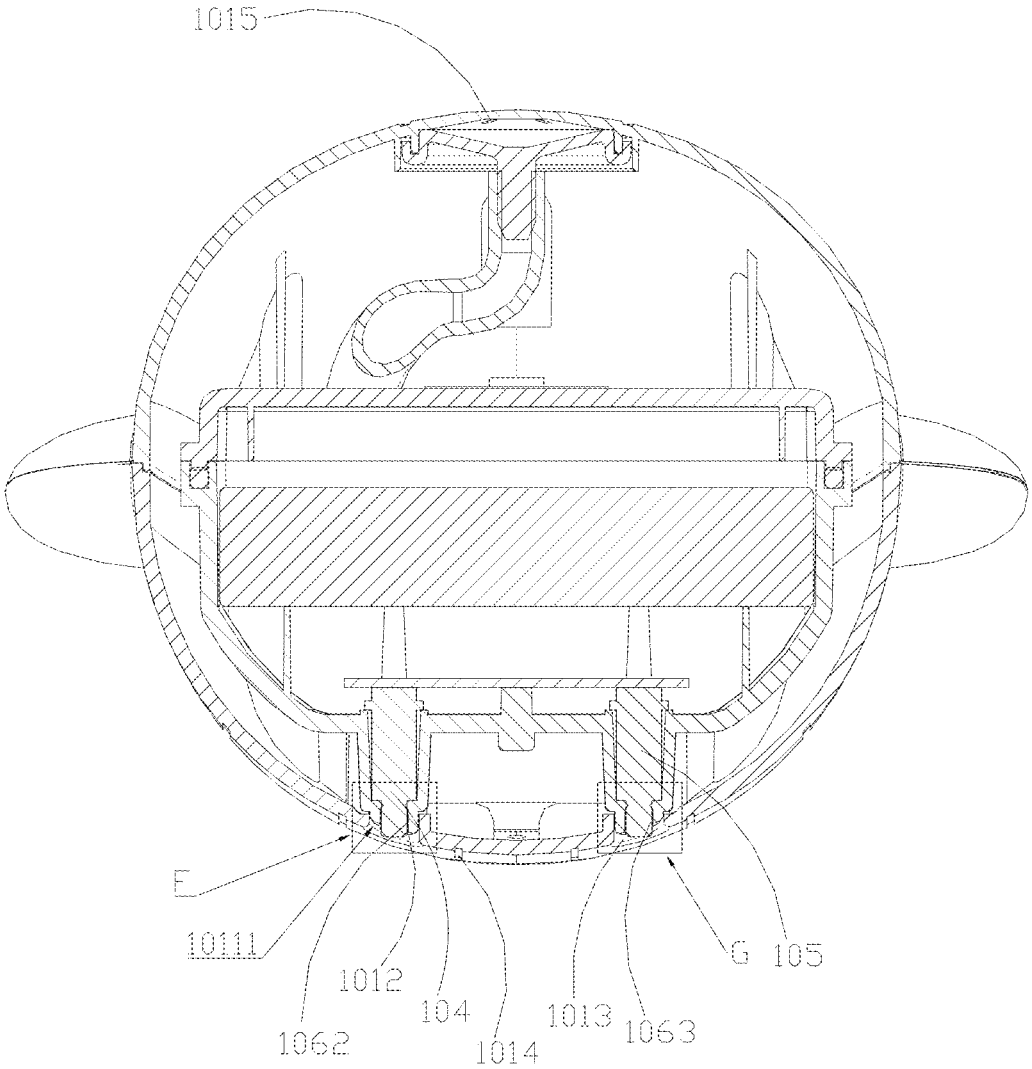
FIG. 25 is a sectional view cut along a first conductive terminal and a second conductive terminal.
Figure 26:
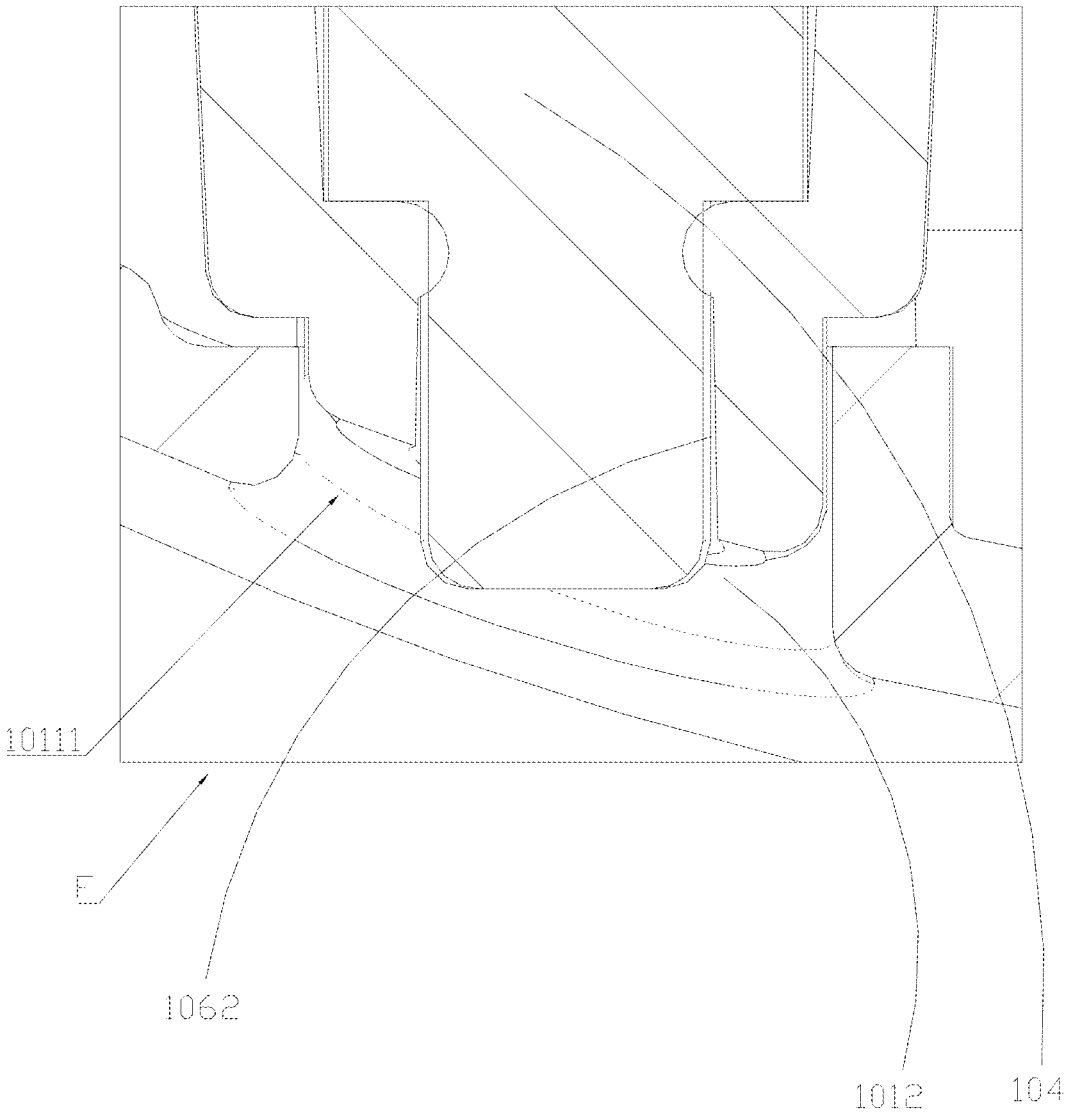
FIG. 26 is an enlarged view of area F in FIG. 25.
Figure 27:
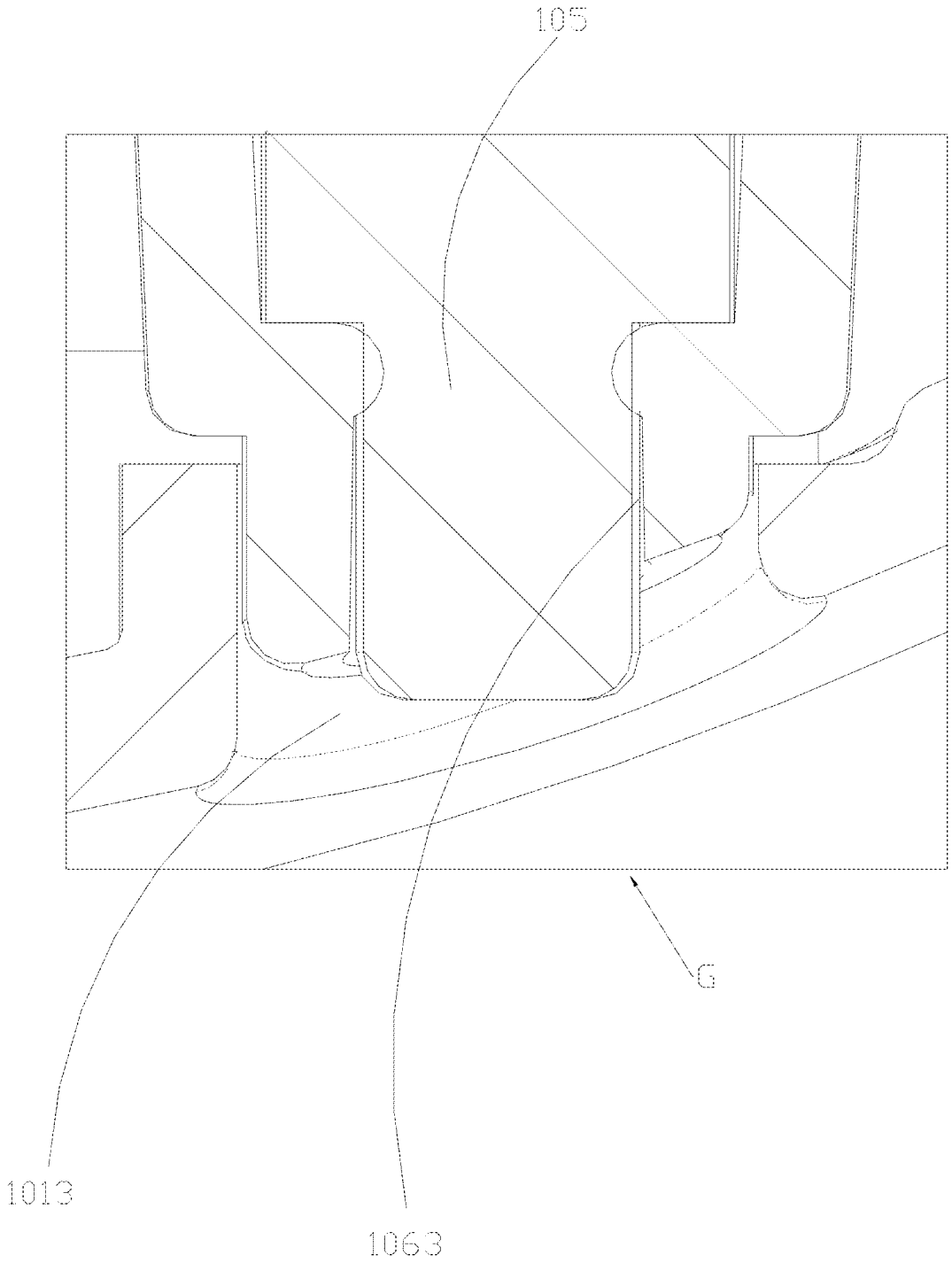
FIG. 27 is an enlarged view of area G in FIG. 25.

In this embodiment, the water toy further includes a water outlet device 1 and a second connecting component 3; and the water outlet device 1 is communicated to the water toy main body 2. The water outlet device 1 here can be a shower head, a shower nozzle, or another water outlet device. The shower head is preferred here, which is more interesting. The water outlet device 1 is communicated to the water toy main body 2 through the second connecting component 3. The second connecting component 3 can be fixed or detachable. The second connecting component 3 in this embodiment is preferably detachable, which facilitates assembling. As shown in FIG. 4, the second connecting component 3 includes a water pipe 31, a protective pipe 32, a first connecting fixing member 33, and a first fastener 34; a first end of the water pipe 31 is connected to the water toy main body 2, and a second end of the water pipe 31 is connected to the water outlet device 1; the first connecting fixing member 33 sleeves the first end of the water pipe 31 and is arranged inside the water toy main body 2; the protective pipe 32 sleeves the water pipe 31 and the first connecting fixing member 33; the first fastener 34 sleeves the protective pipe 32; the first fastener 34 compresses the protective pipe 32 onto the first connecting fixing member 33; a first clamping slot 331 is arranged on an outer side surface of the first connecting fixing member 33; and the first fastener 34 compresses the protective pipe 32 inside the first clamping slot 331. During playing with the water toy, the water outlet device 1 sprays water, and the water is pumped through a water pumping device arranged in the water toy main body 2 and then flows out through the water pipe 31 via the water outlet device 1. The first connecting fixing member 33 here is made of a soft material, such as rubber. In this way, when the first fastener 34 is used to compress the protective pipe to the first connecting fixing member 33, the first fastener 34 can also compress the first connecting fixing member 33 to the water pipe, so that it is difficult for the water to seep into a space between the protective pipe and the water pipe, and the water will not be accumulated. In this way, if a wire passes through the space between the protective pipe and the water pipe, the wire is protected from being soaked in the water, and the lifespan of the wire is prolonged. Furthermore, the water will not penetrate into the water outlet device to damage other electronic elements and the like. By the arrangement of the first clamping slot 331 in the implementation, the first connecting fixing member 33 is connected to the protective pipe, and the first fastener 34 compresses the protective pipe more tightly, which achieves a better anti-falling effect. The first fastener 34 here uses an elastic snap ring with an opening for easy assembling and disassembling. The protective pipe here is made of a soft material.

In this embodiment, the second connecting component 3 further includes a second connecting fixing member 35 and a second fastener 36; the second connecting fixing member 35 sleeves the second end of the water pipe 31 and is arranged inside the water outlet device 1; the protective pipe 32 also sleeves the second connecting fixing member 35; the second fastener 36 sleeves the protective pipe 32, and the second fastener 36 compresses the protective pipe 32 onto the second connecting fixing member 35; a second clamping slot 351 is arranged on an outer side surface of the second connecting fixing member 35; and the second fastener 36 compresses the protective pipe 32 inside the second clamping slot 351. The arrangement of the second connecting fixing member 35 and the second fastener 36 are more convenient for assembling of the water outlet device and the water toy main body 2. When the second fastener 36 is used to compress the protective pipe to the second connecting fixing member 35, the second fastener 36 can also compress the second connecting fixing member 35 to the water pipe, so that it is difficult for the water to seep into a space between the protective pipe and the water pipe, and the water will not be accumulated. In this way, if a wire passes through the space between the protective pipe and the water pipe, the wire is protected from being soaked in the water, and the lifespan of the wire is prolonged. Furthermore, the water will not penetrate into the water outlet device to damage other electronic elements and the like. By the arrangement of the second clamping slot 351 in this embodiment, the second connecting fixing member 35 is connected to the protective pipe, and the second fastener 36 compresses the protective pipe more tightly, which achieves a better anti-falling effect. The second fastener 36 here uses an elastic snap ring with an opening for easier assembling. The assembling time is saved.

In this embodiment, the water toy further includes a water volume control switch 4 and a water pumping component 7; the water toy main body further includes a first shell 21; the first waterproof integrated box 22 and the water pumping component 7 are arranged inside the first shell 21; the water volume control switch 4 is arranged on the water outlet device 1; the water volume control switch 4 is electrically connected to the water pumping component 7 through a first wire 6; one end of the first wire 6 is connected to the water pumping component 7; and the first wire 6 passes between the water pipe 31 and the protective pipe 32 and is connected to the water volume control switch 4. That is, the first wire 6 will not be soaked in the water. This water isolation design greatly improves the safety of the water toy. The arrangement of the water volume control switch 4 increases the fun of the toy and reduces the boring feeling. The water volume control switch can be configured with a plurality of levels, for example, there are a total of three levels. When the water volume control switch is pressed for the first time, a small water volume is achieved; when the water volume control switch is pressed for the second time, a medium water volume is achieved; when the water volume control switch is pressed for the third time, a large water volume is achieved; when the water volume control switch is pressed for the fourth time, the water volume control switch is turned off, and the operations are performed cyclically. However, the water volume control switch is not limited to three levels.

In this embodiment, the water outlet device 1 includes a grip 11 and a water outlet head 12. The grip 11 and the water outlet head 12 are detachably connected. The grip 1 is provided with more than one clamping block 111; the water outlet head 12 is provided with a third clamping slot 121 corresponding to the clamping block 111; and the clamping block 111 is clamped in the third clamping slot 121. The grip 11 is connected to the water outlet head 12; the water outlet head 12 is provided with more than one clamping block 111, and the grip 1 is provided with a third clamping slot 121 corresponding to the clamping block 111; and the clamping block 111 is clamped in the third clamping slot 121. The grip 11 is connected to the water outlet head 12, so that the water outlet head 12 can be removed and replaced, such as a sun-shaped water outlet head. If children do not like this water outlet head, the water outlet head can be replaced with an animal type water outlet head, which can still increase the fun of playing and increase children's knowledge of things.

A mounting slot 122 can be arranged on a back portion of the water outlet head 12. The third clamping slot 121 is arranged in the mounting slot 122. One end of the grip 11 is inserted into the mounting slot 122, and the clamping block 111 is clamped in the third clamping slot 121. A positioning sliding block 123 is arranged inside the mounting slot 122;

the positioning sliding block 123 is arranged on an inner side edge of the mounting slot 122. The end of the grip 11 connected to the water outlet head 12 is provided with a bayonet 112 corresponding to the positioning sliding block 123. The bayonet 112 is clamped with the positioning sliding block 123. A hollow positioning column 124 is also arranged inside the mounting slot 122. The hollow positioning column 124 is communicated to an inside of the water outlet head 12. The end of the grip 11 connected to the water outlet head 12 is provided with a hollow guide column 113 corresponding to the hollow positioning column 124. The hollow guide column 113 is communicated to the water pipe 31. A surrounding wall 114 is arranged on a periphery of the hollow guide column 113. A space exists between the surrounding wall 114 and the hollow guide column 113, and the clamping block 111 is arranged on an outer side of the surrounding wall 114. The bayonet 112 is arranged on the surrounding wall 114. When the grip 11 and the water outlet head 12 are assembled, the bayonet 112 is aligned with the positioning sliding block 123, the hollow guide column 113 is aligned with the hollow positioning column 124, the bayonet 112 is clamped on the positioning sliding block 123, the hollow guide column 113 is inserted onto the hollow positioning column 124, and the clamping block 111 is clamped in the third clamping slot 121, so as to connect the grip 11 with the water outlet head 12. The surrounding wall 114, the hollow guide column 113, and the grip 11 are integrally molded, and the hollow positioning column 124 and the water outlet head 12 are integrally molded. Due to the arrangement of the positioning sliding block 123, the bayonet 112, the hollow guide column 113, and the hollow positioning column 124, it is more convenient for replacement of the water outlet head. In this way, when children play with the water toy, parents can replace the water outlet head that their children like, thus improving the use experience of a customer.

The grip 11 includes a second shell 115 and a second waterproof integrated box 116. The second waterproof integrated box 116 is arranged inside the second shell 115. The water volume control switch 4 includes a control button 41 and a second control circuit board 42. The second control circuit board 42 is arranged inside the second waterproof integrated box 116. The control button 41 is arranged on the second shell 115. The control button 41 is electrically connected to the second control circuit board 42. The first wire 6 is electrically connected to the second control circuit board 42. The second waterproof integrated box 116 is provided with a second opening A 1161 and a second opening B 1162. The control button 41 is electrically connected to the second control circuit board 42 through a sensing element 411. One end of the sensing element 411 is connected to the second control circuit board 42 and is arranged inside the second waterproof integrated box 116. An opposite end of the sensing element 411 extends out of the second waterproof integrated box 116 through the second opening A 1161 and is connected to the control button 41. A sealing ring 1163 is arranged at the second opening A 1161. The sealing ring 1163 seals the second opening A 1161. The first wire 6 is electrically connected to the second control circuit board 42 through the second opening B 1162. A second waterproof sleeve 117 is arranged at a connection between the first wire 6 and the second control circuit board 42. The second waterproof sleeve 117 sleeves the first wire 6. Furthermore, one end of the second waterproof sleeve 117 is fixedly arranged on the second control circuit board 42, and an opposite end of the second waterproof sleeve 117 seals the second opening B 1162. The second waterproof sleeve 117 is in interference fit with the first wire 6. By the use of the second waterproof sleeve 117, it is convenient for mounting and achieves better airtightness. The design of both the sealing ring 1163 and the second waterproof sleeve 117 is to improve the airtightness of the second waterproof integrated box 116. The second waterproof sleeve 117 is made of a soft rubber material, which is non-toxic and harmless and protects the health of children.

The second connecting component 3 in this embodiment further includes a first anti-falling sleeve 321 and a second anti-falling sleeve 322. One end of the protective pipe 32 is arranged inside the first shell 21, and an opposite end of the protective pipe 32 is arranged inside the second shell 115. An outer side of the protective pipe 32 is sleeved with the first anti-falling sleeve 321. The first anti-falling sleeve 321 is arranged between the first shell 21 and the protective pipe 32, and is clamped at a first opening 211 of the first shell 21. The outer side of the protective pipe 32 is also sleeved with the second anti-falling sleeve 322. The second anti-falling sleeve 322 is arranged between the second shell 115 and the protective pipe 32, and is clamped at a second opening 1213 of the second shell 115, which is mainly to prevent the connecting component from falling out of the first shell 21 or the second shell 115. During the arrangement of the anti-falling sleeves, it is preferred to arrange a stop piece on the connecting fixing member to achieve a better anti-falling effect, for example, a stop piece 332 as shown in FIG. 4.

The structural design of the second waterproof integrated box 116 is consistent with that of the first waterproof integrated box, each of which includes the upper shell, the lower shell, the sealing member, and the waterproof chamber. The upper shell is detachably connected to the lower shell through a clasp. A groove is arranged on the lower shell. The sealing member is arranged in the groove. The upper shell is provided with a protrusion. The protrusion compresses the sealing member. In this way, the waterproof performance is better, and an electronic element arranged in the second waterproof integrated box 116 is better protected.

In this embodiment, the clamping block 111 is trapezoidal; the clamping block 111 is provided with a first inclined plane 1111 and a second inclined plane 1112; the first inclined plane 1111 and the second inclined plane 1112 are opposite to each other; and the first inclined plane 1111 is arranged in a direction of the third clamping slot 121. By the arrangement of the first inclined plane 1111 and the second inclined plane 1112, the water outlet head is more convenient to assemble and disassemble, without being stuck.

In this embodiment, the water pumping component 7 includes a first control circuit board 72, a battery 73, a temperature probe 74, and a display screen 75; the first wire 6, the battery 73, the temperature probe 74, and the display screen 75 are all electrically connected to the first control circuit board 72; the first control circuit board 72, the battery 73, and the display screen 75 are all arranged in the first waterproof integrated box 22; the temperature probe 74 is arranged on an outer side of the first waterproof integrated box 22 or can be fixedly arranged on the outer side of the first waterproof integrated box 22; temperature detected by the temperature probe 74 is transmitted to the display screen 75 through the first control circuit board 72, so that the display screen 75 displays temperature information detected by the temperature probe 74. Parents can monitor the temperature of the water in real time. If the water is too cold, children are more likely to catch a cold and get sick. If the water is too hot, children may be scalded. However, adults and children have different sensible temperatures, so it is very important to set temperatures and monitor the temperatures in real time. This improves the user experience. When children are curious about the temperature, parents can patiently explain it to them and popularize knowledge to children. This also improves the fun of playing with the water toy.

In this embodiment, the water pumping component 7 further includes a water pump 71; the water pump 71 is arranged on the outer side of the first waterproof integrated box 22; a first opening B 227 is arranged on the first waterproof integrated box 22; a first waterproof sleeve B 228 is arranged at the first opening B 227; the first waterproof sleeve B 228 seals the first opening B 227; the water pump 71 is electrically connected to the first control circuit board 72 through a second wire 5; one end of the second wire 5 is connected to the first control circuit board 72, and an opposite end of the second wire 5 is connected to the water pump 71 through the first waterproof sleeve B 228; and an inner wall of a through hole of the first waterproof sleeve B 228 compresses the second wire 5.

The first waterproof sleeve B 228 seals the first opening B 227, and the through hole of the first waterproof sleeve B 228 can allow the second wire 5 to pass through. After the second wire 5 passes through the through hole, the first waterproof sleeve B 228 compresses the second wire 5, so that the through hole of the first waterproof sleeve B 228 is in a sealed state. The first opening B 227 is sealed through the first waterproof sleeve B 228, the second wire 5 passes through the first waterproof sleeve B 228, and the first waterproof sleeve B 228 compresses the first opening B 227 and the second wire 5, so that the first waterproof sleeve B 228 is easy to assemble and has a good waterproof effect. This prolongs the lifespan of the water toy and improves the use experience of the customer.

One end of the second wire 5 is configured to be connected to a second electronic element group inside the water pump 71. A first groove is arranged on an outer wall of the water pump 71. A first mounting hole is arranged in the first groove. A first mounting column is arranged at the first mounting hole, and the first mounting column is located in the first groove. The first mounting column is integrally molded with the water pump 71. A first through hole is formed in the first mounting column. The first through hole penetrates through the first mounting column. The first through hole is internally communicated to the water pump 71. The first mounting column is sleeved with a third waterproof sleeve 711. The first waterproof sleeve B 228 and the third waterproof sleeve 711 are each provided with a second through hole. The second through hole of the third waterproof sleeve 711 is communicated to the first through hole. One end of the third waterproof sleeve 711 sleeves the first mounting column and abuts against a bottom wall of the first groove. One end of the second wire 5 is threaded into the water pump via the second through hole of the third waterproof sleeve 711 and the first through hole of the first mounting column in sequence and is connected to the second electronic element group in the water pump 71, and an inner wall of the second through hole of the third waterproof sleeve 711 compresses the second wire 5, so as to seal a gap between the second wire 5 and an inner wall of the third waterproof sleeve 711.

The second through hole of the first waterproof sleeve B 228 sleeves the second wire 5, and the second wire 5 is in interference fit with an inner wall of the second through hole of the first waterproof sleeve B 228, so as to seal a gap between the second wire 5 and the inner wall of the second through hole of the first waterproof sleeve B 228. The first waterproof sleeve B 228 is inserted into the first opening B 227, and an outer wall of the first waterproof sleeve B 228 is in interference fit with an inner wall of the first opening B 227, so as to seal a gap between the outer wall of the first waterproof sleeve B 228 and the inner wall of the first opening B 227, which prevents the water from seeping into the first integrated box and the water pump and improves the safety. Overall speaking, by the arrangement of the first waterproof sleeve B 228 and the third waterproof sleeve 711, the waterproof performance is better, so that playing with the water toy is safer. The first waterproof sleeve B 228 and the third waterproof sleeve 711 are made of soft rubber materials which are non-toxic and harmless and protect the health of children. The first waterproof sleeve B 228 improves the waterproof performance of the waterproof integrated box, and the soft rubber material is convenient to adjust to seal the first opening B 227. The third waterproof sleeve 711 is made of a soft rubber material which is convenient to adjust to seal a connection between the second wire 5 and the water pump 71, thus preventing a failure of powering on and damage to the water toy due to water contact.

In this embodiment, a first display region 2111 is arranged on the first shell 21; a second display region 224 corresponding to the first display region 2111 is arranged on the first waterproof integrated box 22; and a display surface of the display screen 75 corresponds to the first display region 2111 and the second display region 224, so that the display screen 75 achieves displaying through the second display region 224 and the first display region 2111. A temperature on the display screen 75 can be clearly displayed through the second display region 224 and the first display region 2111.

The first waterproof integrated box 22 is provided with a first opening A 225, and the temperature probe 74 is electrically connected to the first control circuit board 72 through a third wire. One end of the third wire is connected to the first control circuit board 72, and an opposite end of the third wire extends out of the first waterproof integrated box 22 through the first opening A 225 and is arranged on the outer side of the first waterproof integrated box 22 or can be directly fixed on the outer side of the waterproof integrated box 22 to avoid wire enwinding and damage to line connection. This also improves the safety. The first opening A 225 is provided with a first waterproof sleeve A 226. The first waterproof sleeve A 226 sleeves the third wire, and the first opening A 225 is sealed. By the arrangement of the first waterproof sleeve A 226, the waterproof performance and safety of the first waterproof integrated box 22 are improved. The first waterproof sleeve A 226 is made of a soft rubber material, which is non-toxic and harmless and protects the health of children. The first waterproof sleeve A 226 improves the waterproof performance of the waterproof integrated box, and the soft rubber material is convenient to adjust to seal the first opening A 225.

In this embodiment, the water toy further includes a charging port. The charging port is connected to the battery. A third opening is arranged on the first shell, and the charging port corresponds to the third opening. A sealing cover that can seal the third opening is arranged at the third opening.

In this embodiment, the water toy further includes an adsorption device 20. The adsorption device 20 is detachably connected to the water outlet device. The adsorption device 20 is used for adsorbing the water outlet device to an external object. The adsorption device 20 includes a clamping part 201 and a suction cup 202. The suction cup is detachably connected to the clamping part, and the clamping part is detachably clamped to the water outlet device. Specifically, a front surface of the clamping part surrounds and forms a C-shaped clamping chamber 2011. The clamping part clamps the water outlet device within the clamping chamber. A rear surface of the clamping part is equipped with a connecting part 2012, and the suction cup is detachably connected to the connecting part. Furthermore, the connecting part 2012 is a sliding slot. A bottom portion of the sliding slot is provided with a sliding slot opening 20121, and a top portion of the sliding slot is provided with a stopper block 20122. A sliding block 2021 is arranged on the suction cup 202. The sliding block slides into the sliding slot through the sliding slot opening, and the stopper block stops the sliding block in the sliding slot.

Overall speaking, the water toy in this embodiment has high safety, good waterproof performance, and a simple structure. Due to the multifunctional settings of the water volume control switch, temperature display, and the replaceable water outlet head, the water toy is fun, and the user experience is improved.

Embodiment Two

Referring to FIGS. 14-27, a water toy includes a toy housing 101, a driving device 102, a power module 103, a first conductive terminal 104, and a second conductive terminal 105.

A side wall of the toy housing 101 surrounds and forms a first accommodating cavity 1011. The toy housing 101 is provided with an eighth opening 1012, a ninth opening 1013, a liquid inlet 1014, and a liquid outlet 1015.

The driving device 102 is positioned in the first accommodating cavity 1011, and the driving device 102 is used for driving liquid to pass through the liquid inlet 1014 and the liquid outlet 1015 in sequence.

The power module 103 is positioned in the first accommodating cavity 1011, and the power module 103 is electrically connected to the driving device 102.

A first end of the first conductive terminal 104 is electrically connected to the power module 103 and the driving device 102, and a second end of the first conductive terminal 104 is exposed from the toy housing 101 through an installation channel 10111.

A first end of the second conductive terminal 105 is electrically connected to the power module 103 and the driving device 102, and a second end of the second conductive terminal 105 is exposed from the toy housing 101 through the installation channel 10111. A gap is provided between the second end of the second conductive terminal 105 and the second end of the first conductive terminal 104. The second end of the second conductive terminal 105 and the second end of the first conductive terminal 104 can be mutually conductive through a conductive medium.

Through the above structure, the water toy includes the toy housing 101, the driving device 102, the power module 103, the first conductive terminal 104, and the second conductive terminal 105. The side wall of the toy housing 101 surrounds and forms the first accommodating cavity 1011. The toy housing 101 is provided with the eighth opening 1012, the ninth opening 1013, the liquid inlet 1014, and the liquid outlet 1015. The driving device 102 is positioned in the first accommodating cavity 1011, and the driving device 102 is used for driving liquid to pass through the liquid inlet 1014 and the liquid outlet 1015 in sequence. The power module 103 is positioned in the first accommodating cavity 1011, and the power module 103 is electrically connected to the driving device 102. The first end of the first conductive terminal 104 is electrically connected to the power module 103 and the driving device 102, and the second end of the first conductive terminal 104 is exposed from the toy housing 101 through the installation channel 10111. The first end of the second conductive terminal 105 is electrically connected to the power module 103 and the driving device 102, and the second end of the second conductive terminal 105 is exposed from the toy housing 101 through the installation channel 10111. The gap is provided between the second end of the second conductive terminal 105 and the second end of the first conductive terminal 104. The second end of the second conductive terminal 105 and the second end of the first conductive terminal 104 can be mutually conductive through the conductive medium. Therefore, when the water toy is placed in liquid, the second end of the second conductive terminal 105 and the second end of the first conductive terminal 104 can be mutually conductive through the conductive medium in the liquid to activate the driving device 102, so that the driving device 102 drives the liquid to pass through the liquid inlet 1014 and the liquid outlet 1015 sequentially and to be sprayed out from the liquid outlet 1015 for children to play in water. Moreover, the driving device 102 drives the liquid to pass through the liquid inlet 1014 and the liquid outlet 1015 in sequence and to be sprayed out from the liquid outlet, a reaction force generated when the liquid is driven will push the toy housing 101 to drift on the liquid, thereby improving the fun and ornamental value of the water toy.

In this embodiment, the water toy further includes a waterproof box 106 and a control motherboard 107. The power module 103, the driving device 102, the first conductive terminal 104, and the second conductive terminal 105 are all electrically connected to the control motherboard 107. The waterproof box 106 is positioned inside the first accommodating cavity 1011. A waterproof cavity 1061 is surrounded and formed by a side wall of the waterproof box 106. The power module 103 and the control motherboard 107 are both positioned inside the waterproof cavity 1061. The installation channel 10111 includes the eighth opening 1012 and the ninth opening 1013. The second end of the first conductive terminal 104 is exposed from the toy housing 101 through the eighth opening 1012, and the second end of the second conductive terminal 105 is exposed from the toy housing 101 through the ninth opening 1013. The waterproof box 106 is also provided with a seventh opening 1062 and a fourth opening 1063. The first end of the first conductive terminal 104 is electrically connected to the power module 103 through the seventh opening 1062, and the first end of the second conductive terminal 105 is electrically connected to the power module 103 through the fourth opening 1063. Specifically, the water toy also includes a charging port 108, and the charging port 108 is electrically connected to the power module 103. Furthermore, the toy housing 101 is also provided with a fifth opening 1016, and the waterproof box 106 is also provided with a sixth opening 1064. The charging port 108 is exposed from the toy housing 101 through the fifth opening 1016 and the sixth opening 1064. Furthermore, the water toy also includes a sealing plug 109 with elasticity. The sealing plug 109 detachably covers the fifth opening 1016 and the charging port 108. The sealing plug 109 is used for sealing the fifth opening 1016 and the charging port 108. Furthermore, the toy housing 101 is also provided with a first installation slot 10171. The fifth opening 1016 is defined in an inner bottom wall of the first installation slot 10171. A first sealing protrusion 1091 is provided on a top surface of the sealing plug 109. The first sealing protrusion 1091 is detachably inserted into the charging port 108 through the fifth opening 1016, and the first sealing protrusion 1091 is used for sealing the charging port 108. A side surface of the sealing plug 109 is provided with a second sealing protrusion 1092. The second sealing protrusion 1092 is pressed against an inner side wall of the first installation slot 10171. The second sealing protrusion 1092 is used for sealing the fifth opening 1016. Furthermore, the toy housing 101 is also equipped with an avoidance slot 1018. The avoidance slot 1018 is defined in one side of the first installation slot 10171. At least one part of the sealing plug is exposed form the first installation slot 10171 through the avoidance slot 1018. Through the above structure, since the power module 103 and the control motherboard 107 are positioned inside the waterproof cavity 1061 of the waterproof box 106, the water can be effectively prevented from entering electronic elements such as the power module 103 and the control motherboard 107, thereby improving the waterproof performance of the water toy, effectively preventing short circuits in the water toy, and extending the service life of the water toy. Moreover, since the first sealing protrusion 1091 is detachably inserted into the charging port 108 through the fifth opening 1016, the first sealing protrusion 1091 is used for sealing the charging port 108, the second sealing protrusion 1092 is pressed against the inner side wall of the first installation slot 10171, and the second sealing protrusion 1092 is used for sealing the fifth opening 1016, through the dual sealing of the first sealing protrusion 1091 and the second sealing protrusion 1092, the waterproof performance of the water toy is further improved, which can prevent liquid from entering electronic elements such as the power module 103 and the control motherboard 107 through the charging port 108, effectively preventing short circuits in the water toy and extending the service life of the water toy. A total number of the second sealing protrusions 1092 is at least two, and at least two second sealing protrusions 1092 are arranged in sequence from top to bottom along a side surface of the sealing plug 109. The charging port is a TYPE-C charging port.

In this embodiment, a first sealing member 1081 is provided between the charging port 108 and an inner wall of the sixth opening 1064. The first sealing member 1081 is used for sealing a gap between the charging port 108 and the inner wall of the sixth opening 1064. A side wall of the first sealing member 1081 is provided with a plurality of sealing convex bars 10811. Through the above structure, the first sealing member 1081 is provided between the charging port 108 and the inner wall of the sixth opening 1064, which can prevent liquid from entering the waterproof cavity 1061 of the waterproof box 106 through the gap between the charging port 108 and the inner wall of the sixth opening 1064, further improving the waterproof performance of the water toy.

In this embodiment, the water toy further includes a liquid guiding pipe 1019. The driving device 102 is equipped with a suction opening 1021. The suction opening 1021 is in communication with the liquid inlet 1014. One end of the liquid guiding pipe 1019 is in communication with the suction opening 1021, and an opposite end of the liquid guiding pipe 1019 is in communication with the liquid outlet 1015. The water toy also includes an end cover 10191. One end of the end cover 10191 is connected to the liquid guiding pipe 1019, and an opposite end of the end cover 10191 detachably covers the liquid outlet 1015, and the end cover 10191 is in communication with the liquid outlet 1015. Specifically, a first installation protrusion 10151 and a second installation protrusion 10152 are provided at the liquid outlet 1015. The end cover 10191 is equipped with a third installation protrusion 101911 and a fourth installation protrusion 101912. A second installation slot 10153 is defined between the first installation protrusion 10151 and the second installation protrusion 10152. A third installation slot 101913 is defined between the third installation protrusion 101911 and the fourth installation protrusion 101912. The third installation protrusion 101911 is inserted into the second installation slot 10153, and the second installation protrusion 10152 is inserted into the third installation slot 101913. The liquid inlet 1014 includes one or more water inlet holes 10141, and the liquid outlet 1015 includes one or more water outlet holes 10154. The driving device 102 is a water pump. Through the above structure, the installation of the liquid guiding pipe 1019 is effectively achieved, and the water pump drives the liquid to flow in the liquid guiding pipe 1019 and to be sprayed out from the liquid outlet 1015, which can increase the pressure of the liquid, improve the effect of liquid spraying, and enhance the fun and ornamental value of the water toy. The first installation protrusion 10151 and the second installation protrusion 10152 are positioned on an inner wall of the toy housing 101.

In this embodiment, the waterproof box body 106 includes a first upper housing 1065 and a first lower housing 1066. The first lower housing 1066 is provided with a fourth installation slot 10661, the first upper housing 1065 is provided with a fifth installation protrusion 10651, and a second sealing member 106611 with elasticity is provided inside the fourth installation slot 10661. The first upper housing 1065 is connected to the first lower housing 1066. Moreover, the fifth installation protrusion 10651 is pressed against an upper side of the second sealing member 106611, and a lower side of the second sealing member 106611 is pressed against an inner bottom wall of the fourth installation slot 10661, so that a side wall of the first upper housing 1065 and a side wall of the first lower housing 1066 surround and form the waterproof cavity 1061. The first upper housing 1065 and the first lower housing 1066 are detachably connected. Specifically, the first upper housing 1065 and the first lower housing 1066 are detachably connected by a buckle 106612. Through the above structure, due to the detachable connection between the first upper housing 1065 and the first lower housing 1066, it is convenient for a user to install electronic elements such as the power module 103 and the control motherboard 107 into the waterproof box 106. Moreover, by installing the second sealing member 106611 between the first upper housing 1065 and the first lower housing 1066, the arrangement of the waterproof box 106 is effectively achieved, preventing liquid from seeping into the waterproof box 106 through a gap between the first upper housing 1065 and the first lower housing 1066. The first sealing member 1081 and the second sealing member 106611 are made of silicone or rubber.

In this embodiment, the toy housing 101 includes a second upper housing 10192 and a second lower housing 10193, and the second upper housing 10192 is detachably connected to the second lower housing 10193. The water toy also includes an installation bracket 101941, and the installation bracket 101941 is positioned at the liquid inlet. The driving device 102 is connected to the toy housing 101 through the installation bracket 101941. Specifically, the toy housing 101 is provided with a sixth installation protrusion 10194 and a seventh installation protrusion 10195. A fifth installation slot 10196 is defined between the sixth installation protrusion 10194 and the seventh installation protrusion 10195. The driving device 102 is connected to one side of the installation bracket 101941, and an opposite side of the installation bracket 101941 is detachably inserted into the fifth installation slot 10196. Through the above structure, the setting of the toy housing 101 is effectively achieved, and it is easy for the user to install the waterproof cavity 1061 and the driving device 102. The toy housing 101 is in an animal shape, and the toy housing 101 can also be in a plant shape. Specifically, the toy housing 101 is in a whale shape.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A water toy, comprising a water toy main body comprising a first shell, wherein the first shell comprises a chamber configured for accommodating water, the first shell is provided with a water inlet and a water outlet; the water inlet, the chamber, and the water outlet are in communication with each other;

a first waterproof integrated box, wherein the first waterproof integrated box is configured for accommodating an electronic element; the first waterproof integrated box comprises a first upper shell, a first lower shell, and a sealing member; the first upper shell and the first lower shell are connected to each other; the sealing member is arranged at mounting ports of the first upper shell and the first lower shell; after the first upper shell and the first lower shell are connected to each other, the sealing member seals a gap between the first upper shell and the first lower shell to form a waterproof chamber between the first upper shell and the first lower shell; and a water pumping component, wherein the first waterproof integrated box and the water pumping component are arranged inside the first shell, and the first waterproof integrated box is positioned in the chamber between the water inlet and a water outlet; and the pumping component is used for driving the water inside the chamber to be sprayed out through the water outlet.

2. The water toy according to claim 1, wherein the water toy further comprises a water outlet device; the water outlet device comprises a water outlet head; the water outlet head of the water outlet device is in communication with the water outlet of the first shell; the water pumping component is used for driving the water in the chamber to pass through the water outlet and water outlet head in sequence and to be sprayed out from the water outlet head.

3. The water toy according to claim 2, wherein the water toy further comprises an adsorption device; the adsorption device is detachably connected to the water outlet device; and the adsorption device is used for adsorbing the water outlet device to an external object.

4. The water toy according to claim 3, wherein the adsorption device comprises a clamping part and a suction cup; the suction cup is detachably connected to the clamping part; and the clamping part is detachably clamped to the water outlet device, and a front surface of the clamping part surrounds and forms a C-shaped clamping chamber; the clamping part clamps the water outlet device within the clamping chamber; a rear surface of the clamping part is equipped with a connecting part; and the suction cup is detachably connected to the connecting part.

5. The water toy according to claim 4, wherein the connecting part is a sliding slot; a bottom portion of the sliding slot is provided with a sliding slot opening; a top portion of the sliding slot is provided with a stopper block; a sliding block is arranged on the suction cup; the sliding block slides into the sliding slot through the sliding slot opening; and the stopper block stops the sliding block in the sliding slot.

6. The water toy according to claim 1, wherein the first waterproof integrated box further comprises a mounting channel; the water toy further comprises:

a first conductive terminal, wherein a first end of the first conductive terminal is electrically connected to the electronic element inside the first waterproof integrated box, and a second end of the first conductive terminal is exposed from the first waterproof integrated box through the mounting channel; and a second conductive terminal, wherein a first end of the second conductive terminal is electrically connected to the electronic element inside the first waterproof integrated box, and a second end of the second conductive terminal is exposed from the first waterproof integrated box through the mounting channel; a gap is provided between the second end of the second conductive terminal and the second end of the first conductive terminal, and the second end of the second conductive terminal and the second end of the first conductive terminal can be mutually conductive through a conductive medium.

7. The water toy according to claim 6, wherein the mounting channel comprises a seventh opening and a fourth opening both positioned in the first waterproof integrated box; the seventh opening and the fourth opening are spaced apart from each other; the second end of the first conductive terminal is exposed from the first waterproof integrated box through the seventh opening, and the second end of the second conductive terminal is exposed from the first waterproof integrated box through the fourth opening.

8. The water toy according to claim 1, wherein the first upper shell and the first lower shell are detachably connected through a clasp.

9. The water toy according to claim 8, wherein a groove is arranged on the first lower shell; the sealing member is arranged in the groove; the first upper shell is provided with a protrusion; the protrusion is inserted into the groove and compresses the sealing member, so that the first upper shell and the first lower shell are hermetically connected to each other; or a groove is arranged on the first upper shell; the sealing member is arranged in the groove; the first lower shell is provided with a protrusion; and the protrusion is inserted into the groove and compresses the sealing member, so that the first upper shell and the first lower shell are hermetically connected to each other.

10. The water toy according to claim 8, wherein the water toy further comprises a water outlet device and a second connecting component; the water outlet device is communicated to the water toy main body; the water outlet device is connected to the water toy main body through the second connecting component;

the second connecting component comprises a water pipe, a protective pipe, a first connecting fixing member, and a first fastener; a first end of the water pipe is connected to the water toy main body, and a second end of the water pipe is connected to the water outlet device; the first connecting fixing member sleeves the first end of the water pipe and is arranged inside the water toy main body; the protective pipe sleeves the water pipe and the first connecting fixing member; the first fastener sleeves the protective pipe; the first fastener compresses the protective pipe onto the first connecting fixing member; a first clamping slot is arranged on an outer side surface of the first connecting fixing member; and the first fastener compresses the protective pipe inside the first clamping slot.

11. The water toy according to claim 10, wherein the second connecting component further comprises a second connecting fixing member and a second fastener; the second connecting fixing member sleeves the second end of the water pipe and is arranged inside the water outlet device; the protective pipe also sleeves the second connecting fixing member; the second fastener sleeves the protective pipe, and the second fastener compresses the protective pipe onto the second connecting fixing member; a second clamping slot is arranged on an outer side surface of the second connecting fixing member; and the second fastener compresses the protective pipe inside the second clamping slot.

12. The water toy according to claim 10, wherein the water toy further comprises a water volume control switch; the water toy main body further comprises a first shell; the water volume control switch is arranged on the water outlet device; the water volume control switch is electrically connected to the water pumping component through a first wire; one end of the first wire is connected to the water pumping component; and the first wire passes between the water pipe and the protective pipe and is connected to the water volume control switch.

13. The water toy according to claim 12, wherein the water pumping component comprises a first control circuit board, a battery, a temperature probe, and a display screen; the first wire, the battery, the temperature probe, and the display screen are all electrically connected to the first control circuit board; the first control circuit board, the battery, and the display screen are all arranged in the first waterproof integrated box; the temperature probe is arranged on an outer side of the first waterproof integrated box; and a temperature detected by the temperature probe is transmitted to the display screen through the first control circuit board, so that the display screen displays temperature information detected by the temperature probe.

14. The water toy according to claim 13, wherein the water pumping component further comprises a water pump; the water pump is arranged on the outer side of the first waterproof integrated box; a first opening B is arranged on the first waterproof integrated box; a first waterproof sleeve B is arranged at the first opening B; the first waterproof sleeve B seals the first opening B; the water pump is electrically connected to the first control circuit board through a second wire; one end of the second wire is connected to the first control circuit board, and an opposite end of the second wire is connected to the water pump through the first waterproof sleeve B; and an inner wall of a through hole of the first waterproof sleeve B compresses the second wire.

15. The water toy according to claim 13, wherein a first display region is arranged on the first shell; a second display region corresponding to the first display region is arranged on the first waterproof integrated box; and a display surface of the display screen corresponds to the first display region and the second display region, so that the display screen achieves displaying through the second display region and the first display region.

16. The water toy according to claim 10, wherein the water outlet device comprises a grip and a water outlet head; the grip is provided with more than one clamping block; the water outlet head is provided with a third clamping slot corresponding to the clamping block; the clamping block is clamped in the third clamping slot; the clamping block is detachably clamped with the third clamping slot; or the water outlet head is provided with more than one clamping block; the grip is provided with a third clamping slot corresponding to the clamping block; the clamping block is clamped in the third clamping slot; and the clamping block is detachably clamped with the third clamping slot.

17. The water toy according to claim 16, wherein the clamping block is trapezoidal; the more than one clamping block is provided with a first inclined plane and a second inclined plane; the first inclined plane and the second inclined plane are opposite to each other; and the first inclined plane is arranged in a direction of the third clamping slot.

18. The water toy according to claim 1, wherein the first shell is in a animal body shape, and the water inlet and the water outlet each are a part of the animal body.

19. A water toy, comprising a water toy main body comprising a first shell, wherein the first shell comprises a chamber configured for accommodating water, the first shell is provided with a water inlet and a water outlet; the water inlet, the chamber, and the water outlet are in communication with each other;

a first waterproof integrated box positioned in the chamber between the water inlet and a water outlet, wherein the first waterproof integrated box is configured for accommodating an electronic element; the first waterproof integrated box comprises a first upper shell, a first lower shell, and a sealing member; the first upper shell and the first lower shell are connected to each other; the sealing member is arranged at mounting ports of the first upper shell and the first lower shell; after the first upper shell and the first lower shell are connected to each other, the sealing member seals a gap between the first upper shell and the first lower shell to form a waterproof chamber between the first upper shell and the first lower shell;

a water outlet device arranged away from the water toy main body; and a water pipe, wherein the water outlet device is communicated to the water toy main body, and the water outlet device is connected to the water toy main body through the water pipe.

20. The water toy according to claim 19, wherein the water pipe is provided a protective pipe, a first connecting fixing member, and a first fastener arranged thereon, the water pipe is in communication with the chamber and water outlet device, the first connecting fixing member connects the water pipe to the first shell, the protective pipe sleeves outside the first connecting fixing member and the water pipe, and first fastener fastens the protective pipe to the first connecting fixing member.

* * * * *